US008886066B2

(12) United States Patent
Matsumoto

(10) Patent No.: US 8,886,066 B2
(45) Date of Patent: Nov. 11, 2014

(54) IMAGE FORMING APPARATUS

(75) Inventor: Yasuhisa Matsumoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 726 days.

(21) Appl. No.: 12/859,363

(22) Filed: Aug. 19, 2010

(65) Prior Publication Data

US 2011/0052275 A1 Mar. 3, 2011

(30) Foreign Application Priority Data

Aug. 28, 2009 (JP) ..... 2009-198635

(51) Int. Cl.
*G03G 15/00* (2006.01)
*G03G 15/01* (2006.01)
*G03G 15/16* (2006.01)

(52) U.S. Cl.
CPC .... *G03G 15/0131* (2013.01); *G03G 2215/0154* (2013.01); *G03G 15/5008* (2013.01)
USPC ..... 399/49; 399/54; 399/66; 399/72; 399/228; 399/301; 399/302; 399/303; 399/396

(58) Field of Classification Search
USPC ..... 399/49, 54, 66, 72, 228, 301–303, 394, 399/396
See application file for complete search history.

(56) References Cited

U.S. PATENT DOCUMENTS

2004/0161268 A1* 8/2004 Tomita et al. ..... 399/301
2005/0271429 A1* 12/2005 Tachibana et al. ..... 399/301
2007/0297817 A1* 12/2007 Bessho ..... 399/27

FOREIGN PATENT DOCUMENTS

JP 2003-228217 A 8/2003

OTHER PUBLICATIONS

U.S. Appl. No. 12/784,036, filed May 20, 2010, Murasaki et al.

* cited by examiner

*Primary Examiner* — Joseph S Wong
(74) *Attorney, Agent, or Firm* — Fitzpatrick, Cella, Harper & Scinto

(57) ABSTRACT

The image forming apparatus detects a color deviation amount in a timing when a developing roller separates from or contacts a photosensitive drum to set a difference in peripheral velocities between the photosensitive drum and an intermediate transfer belt or a transfer material conveying belt based on the color deviation amount and information about the use degree of the intermediate transfer belt.

18 Claims, 14 Drawing Sheets

| THE NUMBER OF SHEETS ON WHICH IMAGES ARE FORMED [$\times 10^3$ SHEETS] | DRUM VELOCITY CORRECTION COEFFICIENT C |
|---|---|
| 0 | a |
| 0.2 | b |
| 7.7 | c |
| 39.4 | d |
| 225 | e |

FIG. 16

| THE NUMBER OF SHEETS ON WHICH IMAGES ARE FORMED [$\times 10^3$ SHEETS] | DRUM VELOCITY CORRECTION COEFFICIENT C CALCULATION COEFFICIENT Q |
|---|---|
| 0 | 1 |
| 0.2 | a |
| 7.7 | b |
| 39.4 | c |
| 225 | d |

IMAGE FORMING APPARATUS

BACKGROUND OF THE INVENTION

1. Field of the Invention

The present invention relates to driving and control of an image forming apparatus for forming an image on a recording medium.

2. Description of the Related Art

In a color image forming apparatus, output images are required to be high quality, and one of the items of the quality of output image includes misregistraton. In order to reduce this color deviation amount, the following processing is performed, for example: toner patches of respective colors are formed on an intermediate transfer belt to detect the color deviation amount, and the positions of the toner patches are detected by registration detection sensor; and the respective color images are written to a photosensitive drum based on the detection result.

An image forming apparatus, in which a plurality of image forming units including photosensitive drums are successively operated, is known to have misregistration that is caused by velocity variation of an intermediate transfer belt. When a transfer material conveying belt, i.e., the intermediate transfer belt, changes its velocity, force exerted on the belt by an image bearing member is changed at a transfer nip at each of the color image forming units. Accordingly, a pulling force or a pushing force of the belt occurs between the transfer nips of the color image forming units, and the belt passes the respective transfer nips at respectively different velocities, which causes misregistration. This is because, when the circumferential velocities of the photosensitive drum and the intermediate transfer belt are different, a frictional coefficient between the photosensitive drum and the intermediate transfer belt changes according to whether a toner enters into a primary transfer nip part, and accordingly a force in the tangent direction changes.

For example, Japanese Patent Application Laid-Open No. 2003-228217 suggests the following solution for this problem. In the technique of Japanese Patent Application Laid-Open No. 2003-228217, charging, developing, and transferring steps performed in image forming units, which are the cause of load variation, are turned on and off while a visible image is not transferred from a drum onto an intermediate transfer member, thus preventing the image from being affected by velocity variation of the intermediate transfer member.

The above technique of Japanese Patent Application Laid-Open No. 2003-228217 does solve the above problem. However, it takes a long time to perform the steps of charging and developing in this method for turning on and off the charging, developing, and transferring steps performed in image forming units while a visible image is not transferred from a photosensitive drum onto the intermediate transfer belt. As a result, there is a possibility that the lifespan of the image forming units may be excessively reduced.

In the first place, the above-described problem of misregistration can be alleviated by reducing the difference between the peripheral velocity of the photosensitive drum and the peripheral velocity of the intermediate transfer belt. In other words, a mechanism for alleviating the difference between the peripheral velocity of the image bearing member such as a photosensitive drum and the peripheral velocity of the intermediate transfer member such as an intermediate transfer belt is desired.

Further, the applicant has studied this issue, and has found that the misregistration caused by the velocity variation of the intermediate transfer belt is changed not only by the difference between the peripheral velocity of the image bearing member and the peripheral velocity of the intermediate transfer member but also by factors such as the state of use of the intermediate transfer belt. In addition, the above occurs not only by the intermediate transfer belt but also by the relationship between the image bearing member and the transfer material conveying belt in the same manner.

Therefore, a mechanism is desired to alleviate the color deviation amount by flexibly reducing the difference of the peripheral velocities between an image bearing member and a rotating member, such as an intermediate transfer member and a transfer material bearing member, that is arranged to face the image bearing member.

SUMMARY OF THE INVENTION

The present invention is configured as follows in order to achieve the above objects.

According to an aspect of the present invention, another purpose of the invention is to provide @ An image forming apparatus comprising an image forming unit that includes a plurality of image bearing members, and transfer members each of which forms a nip part with each of the image bearing members through an intermediate transfer member on which a toner image developed on each of the plurality of image bearing members by the plurality of developing devices is transferred or a transfer material bearing member bearing a transfer material on which the toner image developed on each of the plurality of image bearing members is directly transferred, wherein the image forming apparatus comprises a pattern forming unit that controls the image forming unit to form a position deviation detection pattern on the intermediate transfer member or the transfer material bearing member, wherein the position deviation detection pattern includes a mark of a first color that is formed in a condition where toners have entered into nip parts of the plurality of the image bearing members and a mark of a second color that is formed in a condition where toners have entered into nip parts of the plurality of the image bearing members, the number of the nip parts in the case of forming the mark of the second color is less than the number of the nip parts in the case of forming the mark of the first color; a detection unit which detects positions of the marks of the first and second colors which are included in the position deviation detection pattern; a memory that stores history data of use of the intermediate transfer member or the transfer material bearing member; and a correction unit which corrects a relative velocity between the image bearing member and the intermediate transfer member or the transfer material bearing member, based on data regarding both the positions of the marks of the first and second colors which are detected by the detection unit and the history of use of the intermediate transfer member or the transfer material bearing member stored in the memory.

A further purpose of the invention is to provide an image forming apparatus comprising image forming unit that includes a plurality of image bearing members, a plurality of developing devices that are capable of contacting with or separating from each of the plurality of the image bearing members, transfer members each of which forms a nip part with each of the image bearing members through an intermediate transfer member on which a toner image developed on each of the plurality of image bearing members by the plurality of developing devices is transferred or a transfer material bearing member bearing a transfer material on which the toner image developed on each of the plurality of image bearing members is directly transferred, wherein the image forming apparatus comprises a pattern forming unit that controls the image forming unit form a position deviation detection pattern on the intermediate transfer member or the transfer material bearing member, wherein the position deviation detection pattern includes a mark of a first color that is formed in a condition where the plurality of developing devices contact the plurality of the image bearing members and a mark of a second color that is formed in a condition where the plurality of developing devices whose number is less than the number of the nip parts in the case of forming the mark of the first color separates from or contacts the plurality of image bearing members, a detection unit which detects positions of the mark of the first color and the mark of the second color which are included in the position deviation detection pattern, a memory that stores history data of use of the intermediate transfer member or the transfer material bearing member, and a correction unit that corrects a relative velocity between the image bearing member and the intermediate transfer member or the transfer material bearing member, based on the positions of the marks of the first and second colors which are detected by the detection unit and the history data of use of the intermediate transfer member or the transfer material bearing member stored in the memory.

A still further purpose of the invention will become apparent from the following description of exemplary embodiments with reference to the attached drawings.

BRIEF DESCRIPTION OF THE DRAWINGS

FIG. 16 is a figure illustrating an example of a table for associating information about the use degree of the intermediate transfer belt and a calculation coefficient Q of the drum velocity correction coefficient C.

DESCRIPTION OF THE EMBODIMENTS

The individual embodiments described below will be helpful in understanding a variety of concepts of the present invention from the generic to the more specific. Further, the technical scope of the present invention is defined by the claims, and is not limited by the following individual embodiments.

It should be understood that the following embodiments do not limit the invention set forth in the claims, and all the combinations of features described in the embodiments are not always necessary for the unit of the invention for solving the problem.

<Cross Sectional View Illustrating Full-color Image Forming Apparatus>

Figure 1:
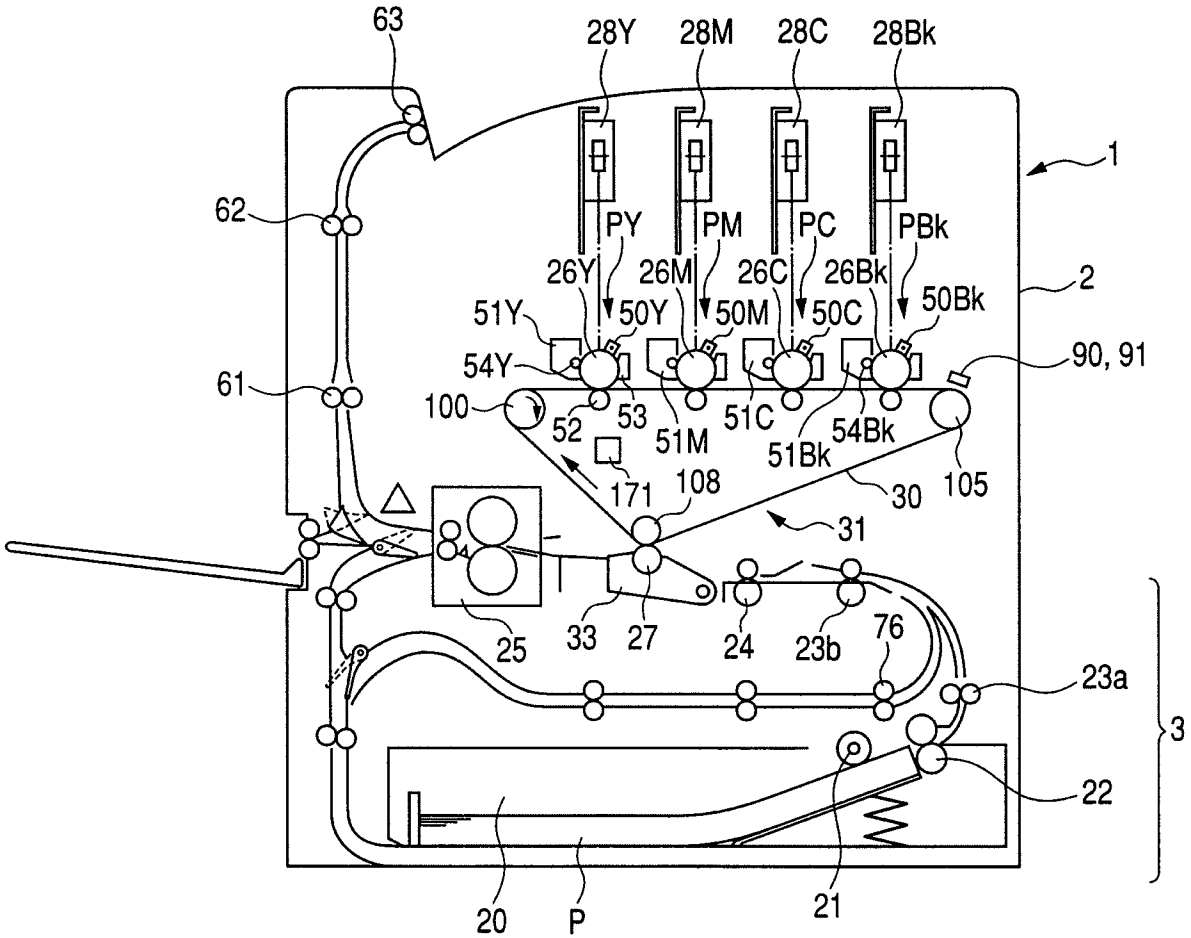
FIG. 1 is a figure illustrating an embodiment of a cross section of a full color image forming apparatus.

FIG. 1 is a schematic view illustrating one of image forming apparatuses according to an embodiment of the present invention, namely, a structure of four-drum full-color image forming apparatus using an intermediate transfer belt.

The four-drum full-color image forming apparatus 1 illustrated in FIG. 1 includes a four-drum full-color image forming apparatus main body 2 serving as a main body of the apparatus. The four-drum full-color image forming apparatus main body 2 includes process cartridges PY, PM, PC, PBk having four colors, i.e., yellow, magenta, cyan, and black, respectively, which are adapted to be capable of separating. The four-drum full-color image forming apparatus main body 2 also includes an intermediate transfer belt unit 31 having an intermediate transfer belt 30 serving as an intermediate transfer member. A fixing device 25 is arranged downstream of a sheet conveying path of the intermediate transfer belt unit 31.

The process cartridges include photosensitive drums 26Y, 26M, 26C, and 26Bk, each serving as an image bearing member, respectively, and primary charging devices 50Y, 50M, 50C, and 50Bk for uniformly charging the surfaces of the photosensitive drums 26Y, 26M, 26C, and 26Bk, respectively. The primary charging devices 50Y, 50M, 50C, and 50Bk are arranged on the peripheral surfaces (on the image bearing members) of the photosensitive drums 26Y, 26M, 26C, and 26Bk, respectively. Further, the process cartridges PY, PM, PC, and PBk include developing device 51Y, 51M, 510, and 51Bk for developing, using toners of corresponding colors, electrostatic latent images formed on the surfaces of the photosensitive drums 26Y, 26M, 26C, and 26Bk exposed by the laser exposure devices 28Y, 28M, 28C, and 28Bk. The process cartridges PY, PM, PC, and PBk are arranged in parallel along the intermediate transfer belt 30.

It should be noted that developing rollers 54 arranged in the developing devices 51Y, 51M, 51C, and 51Bk are capable of separating from the photosensitive drum 26Y, 26M, 26C, and 26Bk together with the developing devices 51Y, 51M, 51C, and 51Bk, and the rotation of the developing rollers 54 may be halted, so that developing agent does not deteriorate. Further, primary transfer rollers 52 are arranged to face the photosensitive drums 26Y, 26M, 26C, and 26Bk at the positions where the intermediate transfer belt 30 is positioned between the primary transfer rollers 52 and the photosensitive drums 26Y, 26M, 26C, and 26Bk. The primary transfer rollers 52 as well as the photosensitive drums 26Y, 26M, 26C, and 26Bk constitute primary transfer parts. The primary transfer rollers 52 serve as transfer members. Further, the photosensitive drums 26Y, 26M, 26C, and 26Bk are driven by a drum drive motor, not illustrated. This drum drive motor 14*b* may be individually arranged on each photosensitive member. Alternatively, one drum drive motor 14*b* may be commonly arranged for several photosensitive members. In the below description, photosensitive drums are used as examples. However, it is to be understood that the present embodiment can also be applied to the photosensitive belt, for example.

On the other hand, the intermediate transfer belt unit 31 includes the intermediate transfer belt 30 and three rollers, i.e., a driving roller 100, a tension roller 105, and a secondary transfer counter roller 108, around which the intermediate transfer belt 30 is looped. In addition, the intermediate transfer belt unit 31 includes an intermediate transfer belt unit nonvolatile memory 171 (hereinafter referred to as nonvolatile memory 171) for storing information about the intermediate transfer belt. A belt drive motor 14*a*, not illustrated, drives and rotates the driving roller 100, so as to rotate and convey the intermediate transfer belt 30. The tension roller 105 is configured to move in a horizontal direction of FIG. 1 according to the length of the intermediate transfer belt 30. Further, in proximity to the tension roller 105, two registration detection sensors 90 are arranged at both longitudinal ends of the roller. The registration detection sensors 90 are arranged to detect a toner patch on the intermediate transfer belt 30 (on the intermediate transfer member). The registration detection sensors 90 are arranged at the portions of the image bearing members that faces the image bearing members, and each of the registration detection sensors 90 includes a light emitting part and a light receiving part. The registration detection sensors 90 cause the light emitting part to emit light onto a toner image formed on the image bearing member or onto the image bearing member itself, and cause the light receiving part to receive reflected light. For example, in a case where a light is emitted onto the color deviation amount detection pattern described as below, and a reflected light thereof is received, the registration detection sensors 90 detects the position of the color deviation amount detection pattern or a mark based on change in the reflection of the image bearing member and the misregistration detection pattern. Then, an image forming control part 12 calculates the color deviation amount between colors from a difference of detection timing between colors. A below-described mark sensor 91 is also similar the above configuration. In the present embodiment, the color deviation amount includes a plus (positive) and a minus (negative) which is opposite to the direction of the plus (positive). Accordingly, the color deviation amount involves the concept of direction (sign). Therefore, the color deviation amount may also be referred to as a misregistration value having a sign. In the below description, "the color deviation amount" is used for description.

A secondary transfer roller 27 is arranged at position opposite to the secondary transfer counter roller 108 via the intermediate transfer belt 30. The secondary transfer roller 27 is held by a transfer conveying unit 33. A feeding part 3 for feeding a transfer material to a secondary transfer part is constituted by a contact part between a secondary transfer roller 27 and the secondary transfer counter roller 108 arranged to face the secondary transfer roller 27 via the intermediate transfer belt 30. The feeding part 3 includes a cassette 20 containing a plurality of transfer materials, a feeding roller 21, a pair of retard rollers 24 for prevention of multi-feeding, pairs of conveying rollers 23*a*, and 23*b*, a pair of registration rollers 24, and the like. Pairs of discharge rollers 61, 62 and 63 are arranged on a conveying path on downstream of the fixing device 25.

The belt drive motor 14*a* is a driving unit for rotating and driving the intermediate transfer belt 30 at a predetermined velocity according to an instruction given by the image forming control part. The drum drive motor 14*b* is a driving unit for rotating and driving all the photosensitive drums 26 at a predetermined velocity according to an instruction given by the image forming control part.

<Block Diagram Illustrating Structure of Image Forming Apparatus>

Figure 2:
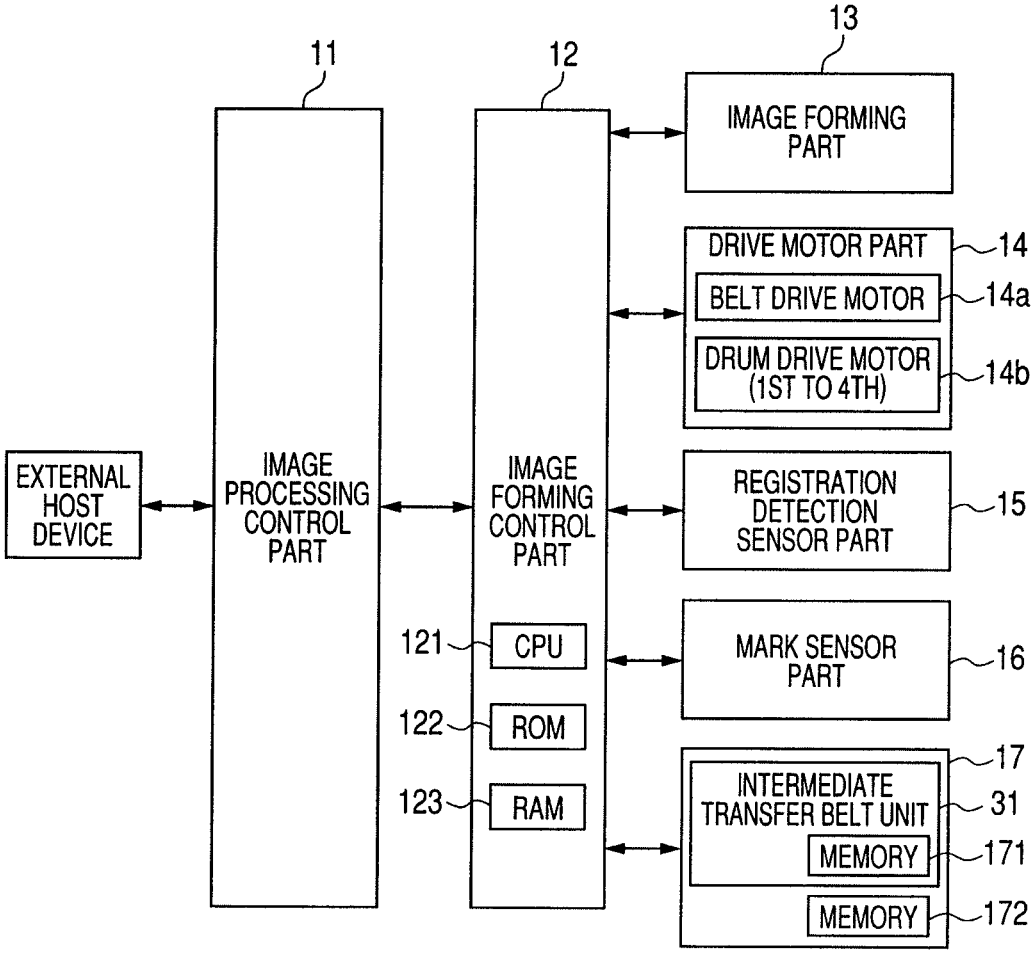
FIG. 2 is a block diagram illustrating an embodiment of a structure of an image forming apparatus.

Subsequently, FIG. 2 is a block diagram illustrating a control structure of the image forming apparatus according to the embodiment of the present invention.

The apparatus main body 2 illustrated in FIG. 1 receives an image signal (RGB signal, Page Description Language data) from an external host device 10 such as a personal computer connected communicatively or a document reading part, not illustrated, separately arranged on the apparatus main body. The image processing control part 11 converts the received image signal into a CMYK signal, corrects the grayscale and density, and thereafter generates an exposure signal for the laser exposure device 28.

The image forming control part 12 not only centrally controls the below-described image forming operation, but also controls the apparatus main body 2 when the image forming operation is corrected using the registration detection sensors 90 and the mark sensors 91. The image forming control part 12 includes a CPU 121, a ROM 122 for storing programs executed by the CPU 121, and a RAM 123 for storing various kinds of data during the control processing performed by the CPU 121.

As illustrated in FIG. 1, the image forming part 13 includes the photosensitive drum 26, and also includes a charging unit, a developing unit, a cleaning unit, and an exposure unit acting on this photosensitive drum 26. One or multiple image forming parts 13 are arranged in the rotating direction of the intermediate transfer belt 30.

Reference numeral 14 denotes the belt drive motor 14*a* and the drum drive motor 14*b*. The belt drive motor 14*a* is a driving unit for adjusting the conveying velocity of the intermediate transfer belt 30 according to an instruction given by the image forming control part 12. A registration detection sensor part 15 uses the registration detection sensors 90 to detect the toner patch on the intermediate transfer belt 30. The mark sensor detection part 16 uses the mark sensors 91 to detect position indication marks arranged on the intermediate transfer belt 30.

Figure 8A:
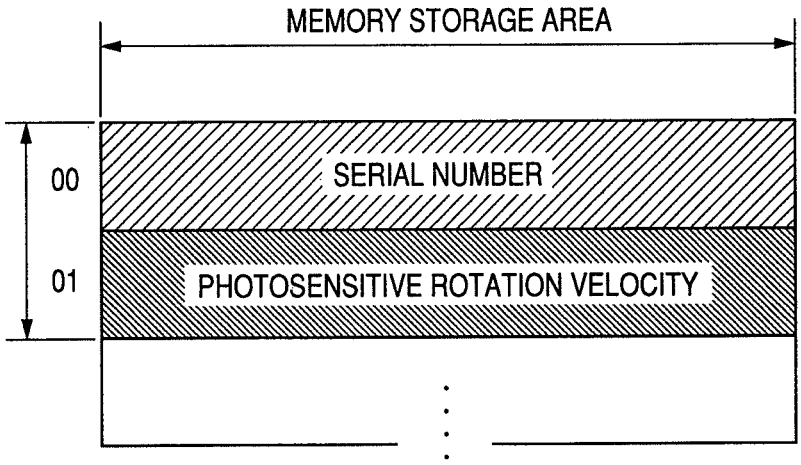
FIG. 8A is a data map of a main body nonvolatile memory.
Figure 8B:
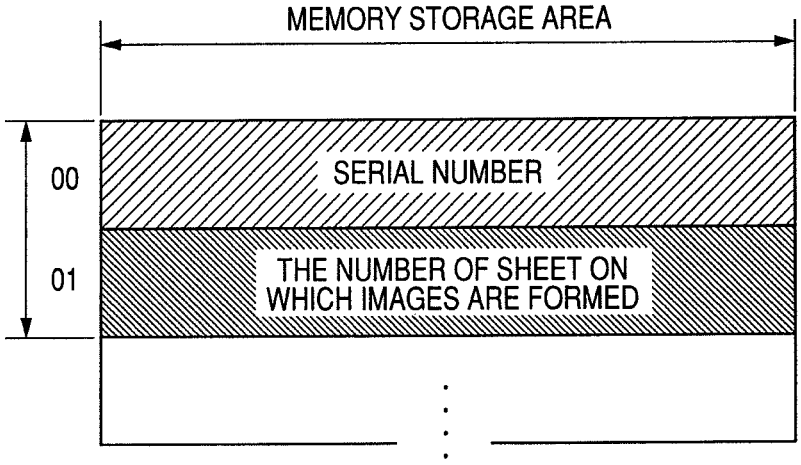
FIG. 8B is a data map of an intermediate transfer belt unit nonvolatile memory.

Reference numeral 17 denotes the nonvolatile memory 171 arranged on the intermediate transfer belt unit 31 and the nonvolatile memory 172 (hereinafter referred to as nonvolatile memory 172) arranged on the apparatus main body 172. The CPU 121 of the image forming control part 12 reads data from the nonvolatile memories 171 and 172, and writes data into the nonvolatile memories 171 and 172. The nonvolatile memory 171 stores the serial number of the intermediate transfer belt unit, the number of sheets on which images are formed, and the like. FIG. 8B illustrates a data map of the nonvolatile memory 171. The nonvolatile memory 172 stores the serial number of the intermediate transfer belt unit, the rotational velocity of the photosensitive drum, and the like. FIG. 8A illustrates a data map of the nonvolatile memory 172. The serial number stored in the nonvolatile memory 172 corresponds to updated data that is read from the nonvolatile memory 171 of a new intermediate transfer belt unit 31 when the new intermediate transfer belt unit 31 is attached to the apparatus main body 2.

<Description of Image Forming Operation>

The image forming operation of the four-drum full-color image forming apparatus 1 structured as described above will be hereinafter described with reference to FIG. 1. When image forming operation starts, transfer materials P in the cassette 20 is fed by the feeding roller 21, and are separated into each sheet by the pair of retard rollers 22. Then, the recording material P is conveyed through the pair of conveying rollers 23*a* and 23*b* to the pair of registration rollers 24. On the other hand, while the transfer material is thus conveyed, the surface of the photosensitive drum 26Y in the yellow process cartridge PY is uniformly charged to minus potential by the primary charging device 50. Subsequently, the laser exposure device 28Y exposes an image, thereby forming an electrostatic latent image, corresponding to the yellow image component of the image signal, on the surface of the photosensitive drum 26Y.

Subsequently, while the developing roller 54Y in the developing device 51 is driven and rotated, the developing roller 54Y comes into contact with the photosensitive drum 26Y, and the developing device 51 develops the electrostatic latent image using the yellow toner charged to minus potential, thus making the electrostatic latent image into a visible yellow toner image. Alternatively, the contact of the developing device 51 may be made immediately before the formation of the electrostatic latent image. The thus obtained yellow toner image is primarily transferred onto the intermediate transfer belt 30 by the primary transfer roller 52 having a primary transfer bias applied thereto. After the toner image has been transferred, a residual toner remaining on the surface of the photosensitive drum 26Y is removed by a cleaner 53.

The above series of toner image forming operation is successively performed by the other process cartridges PM, PC, and PBk. The color toner images formed on the photosensitive drums 26 are primarily transferred by the respective primary transfer parts, and are overlaid on the intermediate transfer belt 30. It should be noted that when the developing roller 54 finishes the developing operation, the developing rollers 54 are successively separated from the photosensitive drums 26 even if a downstream process cartridge is performing primary transfer. Then, the rotation of the developing rollers 54 is halted, so that a developing agent does not deteriorate. This contact-separation sequence of the developing device 51 will be illustrated in below-described FIG. 10.

Subsequently, the four-color toner images overlaid and transferred on the intermediate transfer belt 30 is moved to a secondary transfer part according to the rotation of the intermediate transfer belt 30 in the arrow direction. Then, the transfer material is fed to the secondary transfer part in synchronous with timing of the image on the intermediate transfer belt 30. Thereafter, the four-color toner image on the intermediate transfer belt 30 is secondarily transferred onto the transfer material by the secondary transfer roller 27 in contact with the intermediate transfer belt 30 via the transfer material. Then, the transfer material having the toner image thus transferred thereon is conveyed to the fixing device 25, and is heated and pressurized, so that the toner image is fixed thereon. Thereafter, the pairs of discharge rollers 61, 62, 63 discharge and stack the transfer material onto the upper surface of the apparatus main body.

On the other hand, after the secondary transfer, an intermediate transfer belt cleaning device arranged in proximity to the driving roller 100 removes residual toner remaining on the surface of the intermediate transfer belt 30.

<Description of Intermediate Transfer Belt Unit>

Subsequently, the intermediate transfer belt unit 31 according to the present embodiment will be described.

Figure 3A:
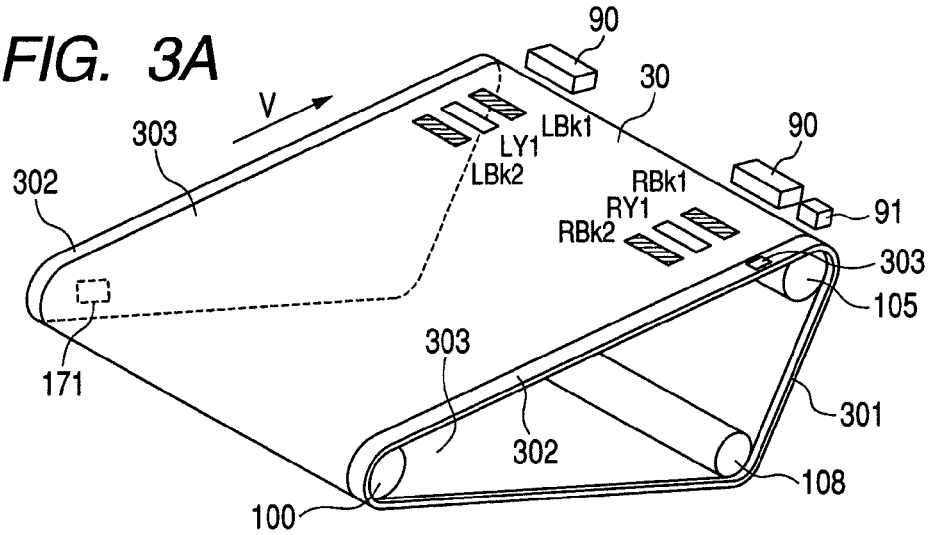
FIGS. 3A, 3B and 3C are a figure illustrating a perspective view of an intermediate transfer belt and a detection pattern of the color deviation amount.

FIG. 3A is a perspective view illustrating the structure of the intermediate transfer belt unit 31. The intermediate transfer belt 30 rotates at a velocity V [mm/s] in the arrow direction of the figure. The intermediate transfer belt 30 employed in the present embodiment has deviation restriction ribs 301 attached to both end sections of the inner surface of the belt in order to prevent deviation of the belt. This deviation restriction ribs 301 are restricted by deviation restriction flanges, not illustrate, arranged on both ends of the tension roller 105, thus preventing deviation of the belt. In addition, transparent belt reinforcement tapes 302 are pasted to both end sections of the outer peripheral surface of the belt in order to prevent the intermediate transfer belt 30 from being damaged. The registration detection sensors 90 are reflective optical sensors for detecting a non-fixed toner patch formed on the intermediate transfer belt 30. In the present embodiment, one registration detection sensor 90 is arranged at each of the both ends in the longitudinal direction of the tension roller 105. Further, the intermediate transfer belt unit has the readable/writable nonvolatile memory 171 arranged on the left side surface with respect to the rotating direction of the intermediate transfer belt 30. As described in FIGS. 8A and 8B, the nonvolatile memory 171 stores information about the use degree (the number of sheets on which images are formed) about the history of use of the intermediate transfer belt unit 31. It should be noted that the information about the use degree has the same meaning as the information about the history of use. Every time the image forming operation is performed, the image forming control part 12 accesses the nonvolatile memory 171 of the intermediate transfer belt unit 31 to update the number of sheets on which images are formed. In the present embodiment, the number of sheets on which images are formed is used as information about use degree of the intermediate transfer belt unit 31. However, the information about use degree of the intermediate transfer belt unit 31 is not limited to the number of sheets on which images are formed, and may be a time for which the intermediate transfer belt drive motor rotates. Alternatively, the information about the history of use may be, e.g., the number of effective pixels (pixel count) about the intermediate transfer belt unit 31 in a case where a laser is emitted according to an image signal.

<Mechanism of Misregistration>

Subsequently, the mechanism of misregistration will be described. In a driving transmission system for driving the intermediate transfer belt 30 constituted by rows of gears, the load torque causes deformation of a tooth face of a gear and a sheet metal supporting the driving transmission system, and causes inclination of a shaft supporting a gear, which causes a delay in the driving transmission. As a result, when there is a torque variation of the drive roller shaft that drives the intermediate transfer belt 30 according to the timing of contact/separation of the developing roller 54, the velocity of the intermediate transfer belt 30 is changed. This velocity variation arises when there is a change in the load torque which causes a change in the variation of the driving transmission system. This velocity variation does not arise when the load torque is constant and the variation of the driving transmission system is constant.

In a case where the peripheral velocity of the photosensitive drum 26 is slower than the peripheral velocity of the intermediate transfer belt 30, the peripheral velocity of the intermediate transfer belt increases when the developing roller 54 comes into contact. When the torque does not change, the peripheral velocity of the intermediate transfer belt is constant, and the peripheral velocity of the intermediate transfer belt decreases when the developing roller 54 is separated.

On the contrary, in a case where the relationship in terms of velocity between the photosensitive drum 26 and the intermediate transfer belt 30 is configured such that the peripheral velocity of the photosensitive drum is faster than the peripheral velocity of the intermediate transfer belt, the peripheral velocity of the intermediate transfer belt 30 decreases when the developing roller 54 comes into contact, and the peripheral velocity of the intermediate transfer belt 30 increases when the developing roller 54 is separated. Subsequently, with regard to the velocity variation of the intermediate transfer belt 30, the reason why the velocity of the intermediate transfer belt 30 is increased and decreased will be further described in detail.

<Description of Velocity Variation of Intermediate Transfer Belt 30>

The velocity variation of the intermediate transfer belt 30 will be further described in detail.

(i) Velocity Variation when Toner Enters

Figure 4:
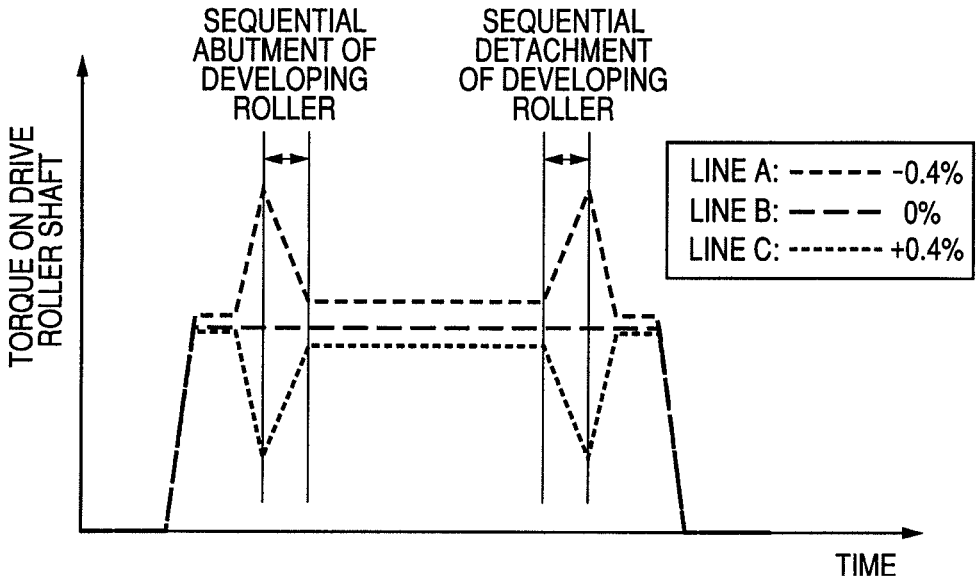
FIG. 4 is figure illustrating an example of time change in a torque on a drive roller shaft that drives the intermediate transfer belt during printing operation.

FIG. 4 illustrates the load torque on the drive roller shaft during printing operation in a case where the difference between the peripheral velocity of the photosensitive drum 26 and the peripheral velocity of the intermediate transfer belt 30 is zero or substantially zero and a case where the velocity of the photosensitive drum 26 is changed to intentionally make a difference in the peripheral velocities. It should be noted that "the difference in the peripheral velocities" unit the difference between the velocity of the photosensitive drum at the primary transfer nip part in the tangent direction and the velocity of the intermediate transfer belt. In FIG. 4, LINE A denotes a load torque on the drive roller shaft when the peripheral velocity of the photosensitive drum is less than the peripheral velocity of the intermediate transfer belt by 0.4%. LINE B denotes a load torque thereof when the peripheral velocity of the photosensitive drum is the same as or substantially the same as the peripheral velocity of the intermediate transfer belt. LINE C denotes a load torque of the drive roller shaft when the peripheral velocity of the photosensitive drum is more than the peripheral velocity of the intermediate transfer belt by 0.4%. Herein, "the peripheral velocity of the photosensitive drum" unit the velocity of the surface of the photosensitive drum at the nip part in the tangent direction. On the other hand, "the peripheral velocity of the intermediate transfer belt" unit the velocity of the intermediate transfer belt at the nip part in the conveying direction.

As described above, it is understood from FIG. 4 that when there is a difference between the peripheral velocity of the photosensitive drum 26 and the peripheral velocity of the intermediate transfer belt 30, there is a transitional torque variation during the image forming operation. This torque variation arises from when the developing roller 54Y comes into contact with the yellow photosensitive drum 26Y while the developing roller 54 in the developing device 51 is driven and rotated. Thereafter, the developing rollers 54 of respective colors arranged downstream of the developing roller 54Y successively come into contact with the photosensitive drums 26. After the black developing roller 54Bk comes into contact with the photosensitive drum 26Bk, the torque variation converges. Then, when the primary transfer of yellow is finished, and the developing roller 54Y separates from the photosensitive drum 26Y, the torque variation arises again.

Figure 5:
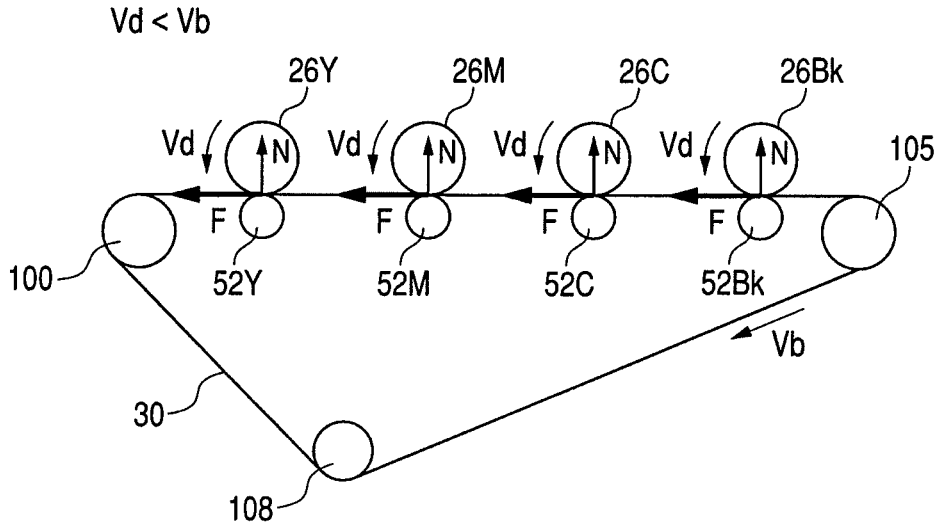
FIG. 5 is a figure illustrating a force in the tangent direction that is exerted on the intermediate transfer belt at a primary transfer nip part.

Toner entering into the primary transfer nip is the cause why the torque changes when the developing roller is separated. The toner enters into the primary transfer nip as follows. Toner on the developing roller 54Y attaches to the photosensitive drum as even though the photosensitive drum is in a latent image-formed state. Thereafter, the fog toner may reach the primary transfer nip part between the photosensitive drum and the intermediate transfer belt. FIG. 5 illustrated an example in which a force in the tangent direction is exerted on the primary transfer nip where the velocity of the photosensitive drum 26 (Vd) is less than the velocity of the intermediate transfer belt 30 (Vb). It should be noted that "the force in the tangent direction" unit a force exerted in the tangent direction of the photosensitive drum at the primary transfer nip part. In FIG. 5, a normal force N is exerted at the primary transfer nip. The normal force N is represented as a summation of a primary transfer pressure Np, i.e., a mechanical pressing force, and an electrostatic attracting force Ne, i.e., an electric attracting force. When there is a difference in the peripheral velocities, a force F in the tangent direction exerted at the primary transfer nip is expressed as the following formula (1), in which a frictional coefficient between the photosensitive drum 26 and the intermediate transfer belt 30 is denoted as μ.

$$F=\mu\times(Np+Ne) \qquad \text{formula (1)}$$

Where there are four-color photosensitive drums 26, the force F in the tangent direction is exerted at each of the primary transfer nips. The resultant of the forces of respective colors in the tangent direction is exerted on the intermediate transfer belt 30.

Where a frictional coefficient between the photosensitive drum 26 and the intermediate transfer belt 30 without any toner at the primary transfer nip is denoted as μ1, and a frictional coefficient therebetween with a toner at the primary transfer nip is defined as μ2, μ1>μ2 holds.

A force T exerted on the intermediate transfer belt 30 without any toner at the primary transfer nip is expressed as formula (2). It is understood from this formula (2) that the intermediate transfer belt 30 receives a load four times as much as a load exerted on the photosensitive drum 26.

$$T=\mu 1\times(Np+Ne)\times 4 \qquad \text{formula (2)}$$

Then, the image forming operation starts. When the developing roller 54Y comes into contact with the yellow photosensitive drum 26Y, and toner enters into the yellow primary transfer nip, a force T1 exerted on the intermediate transfer belt 30 is expressed as formula (3).

$$T1=\mu 1\times(Np+Ne)\times 3+\mu 2\times(Np+Ne) \qquad \text{formula (3)}$$

Thereafter, when the developing roller 54 of respective colors come into contact with the photosensitive drums 26, and toners enter into the primary transfer nips, the force exerted on the intermediate transfer belt 30 changes as follows: formula (4), formula (5), and formula (6).

$$T2=\mu 1\times(Np+Ne)\times 2+\mu 2\times(Np+Ne)\times 2 \qquad \text{Formula (4)}$$

$$T3=\mu 1\times(Np+Ne)+\mu 2\times(Np+Ne)\times 3 \qquad \text{formula (5)}$$

$$T4=\mu 2\times(Np+Ne)\times 4 \qquad \text{formula (6)}$$

Since μ1>μ2 holds, the forces exerted on the intermediate transfer belt 30 are as follows: T1>T2>T3>T4.

Where the peripheral velocity (Vd) of the photosensitive drum 26 and the peripheral velocity (Vb) of the intermediate transfer belt 30 satisfy Vd<Vb, the photosensitive drum 26 plays a role as a brake for the intermediate transfer belt 30. In this case, as illustrated in FIG. 4, when the primary transfer roller comes into contact with the photosensitive drum 26 at the start of the image forming operation, and the primary transfer bias is applied, the torque on the drive roller shaft increases. At this moment, the force exerted on the intermediate transfer belt 30 is T. Thereafter, the developing rollers 54 of respective colors come into contact with the photosensitive drums 26, and the force exerted on the intermediate transfer belt 30 changes as follows: T1, T2, and T3. Accordingly, the torque on the drive roller shaft gradually decreases. Then, after toner enters into the black primary transfer nip, and the force exerted on the intermediate transfer belt 30 attains T4, the force in the tangent direction no longer changes. As a result, the torque on the drive roller shaft no longer changes.

When the primary transfer of yellow is finished, and the developing roller 54Y separates from the photosensitive drum 26Y, there is no toner at the primary transfer nip of yellow. At this moment, the force exerted on the intermediate transfer belt 30 attains T3. The developing rollers 54 of respective colors separates from the photosensitive drums 26, the force exerted on the intermediate transfer belt 30 changes as follows: T2, T1, and T. Since the force increases, the torque on the drive roller shaft increases.

On the contrary, where the peripheral velocity (Vd) of the photosensitive drum 26 and the peripheral velocity (Vb) of the intermediate transfer belt 30 satisfy Vd>Vb, the photosensitive drum 26 plays a role of assisting the rotation of the intermediate transfer belt 30. When the developing rollers 54 of respective colors successively begin to come into contact, the photosensitive drum 26 provides a less assisting force for assisting the rotation of the intermediate transfer belt 30. Accordingly, the torque on the drive roller shaft gradually increases. When the primary transfer is finished, and the developing rollers 54Y begin to separate from the photosensitive drums 26, the photosensitive drum 26 provides a more assisting force for assisting the rotation of the intermediate transfer belt 30. As a result, the torque on the drive roller shaft decreases.

Figure 6:
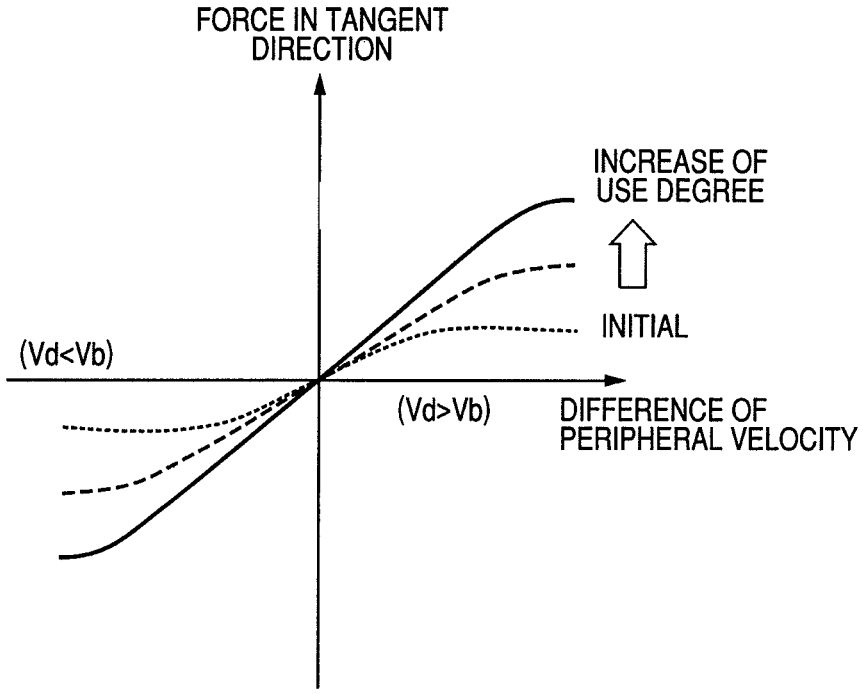
FIG. 6 is a figure illustrating an example of a relationship between the force in the tangent direction exerted on the primary transfer nip and the difference between the peripheral velocity of the photosensitive drum and the peripheral velocity of the intermediate transfer belt.

(ii) Velocity Variation Due to the Degree of Difference in Peripheral Velocities FIG. 6 illustrates a relationship between the force exerted at the primary transfer nip in the tangent direction and the difference between the velocity of the photosensitive drum 26 and the velocity of the intermediate transfer belt 30. In the horizontal axis, the difference in the peripheral velocities is positive where the velocity Vd of the photosensitive drum 26 is faster than the velocity Vb of the intermediate transfer belt 30. This is also applicable to FIGS. 12A and 12B which are described below. When the difference in the peripheral velocities is very small, the force in the tangent direction increases with the difference in the peripheral velocities. When the difference in the peripheral velocities becomes large, the force in the tangent direction becomes constant. This is because the frictional coefficient μ changes in effect due to the magnitude of the difference in the peripheral velocities.

When the difference in the peripheral velocities is zero or substantially zero, the photosensitive drum 26 and the intermediate transfer belt 30 are in rolling contact with each other. Accordingly, the frictional coefficient is zero (the frictional force is not substantially exerted). However, when the difference in the peripheral velocities is very small, rolling contact and sliding contact are coexisting. Accordingly, as the difference in the peripheral velocities increases, the frictional coefficient increases in effect. Then, when the difference in the peripheral velocities becomes larger than a certain value, the photosensitive drum 26 and the intermediate transfer belt 30 come into sliding contact, and the frictional coefficient becomes constant. Therefore, the difference in the peripheral velocities and the force in the tangent direction are in the relationship as illustrated in FIG. 6.

(iii) Velocity Variation Due to the Degree of Use

At this occasion, in the case where the surface roughness of the intermediate transfer belt 30 becomes larger, the frictional coefficient μ also becomes larger. The intermediate transfer belt 30 is damaged according to its use degree, and the surface roughness becomes larger. As illustrated in FIG. 6, even though the difference in the peripheral velocities is the same, a larger force F in the tangent direction in the case of a new intermediate transfer belt 30 is larger than that in the case of the increase of the use degree of intermediate transfer belt 30. This can be applied to not only the intermediate transfer belt 30 but also the photosensitive drum 26. It should be noted that "use degree" or "degree of use" unit how long a certain member is used, and "increase of the use degree" implies how much a certain member deteriorates.

(iv) Velocity Variation Due to Other Reasons

In addition to the cause of the velocity variation of the intermediate transfer belt 30 as described above, examples of causes of the velocity variation thereof include the environment of the image forming apparatus (e.g., temperature and/or humidity), the tolerance (manufacturing error) of the external diameter of the driving roller 100 due to manufacturing conditions, and the like. Further, for example, aged deterioration of the image apparatus is also the cause of the velocity variation of the intermediate transfer belt 30. These other causes vary the degree of the velocity variation caused by the above-described items (i) to (iii). In contrast, the image forming apparatus according to the present embodiment can flexibly cope with these various causes, and suppresses the velocity variation of the intermediate transfer member during the image forming operation, thus alleviating the color deviation amount.

<Relationship Between Color Deviation Amount and Velocity Variation of Intermediate Transfer Belt 30>

Figure 7A:
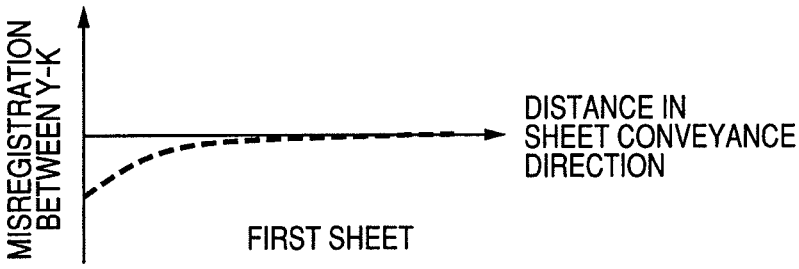
FIGS. 7A, 7B and 7C are a figure illustrating an example of misregistration of yellow with respect to black when three LTR sheets are successively printed.
Figure 7B:
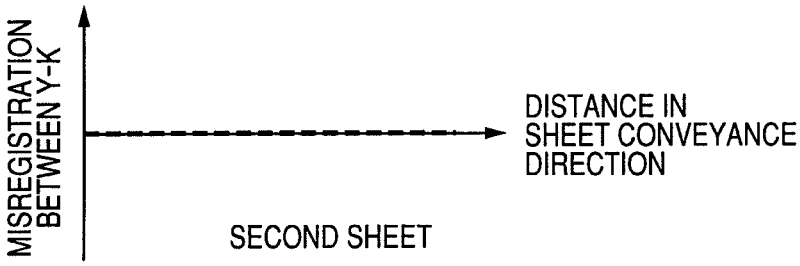
Figure 7C:
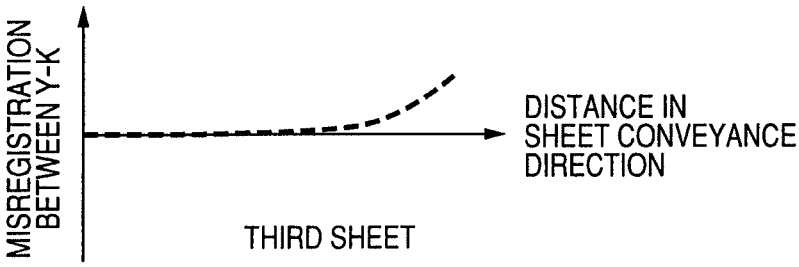

Subsequently, the relationship between the Color deviation amount and the velocity variation of the intermediate transfer belt 30 will be described. FIGS. 7A to 7C illustrate the color deviation amount of yellow with respect to black in a case where three LTR sheets are successively output while the velocity (Vd) of the photosensitive drum 26 and the velocity (Vb) of the intermediate transfer belt 30 satisfy Vd<Vb. FIG. 7A illustrates misregistration of the first sheet. FIG. 7B illustrates misregistration of the second sheet. FIG. 7C illustrates misregistration of the third sheet. In this example, a value in the vertical axis is positive when a yellow image is displaced to a rear edge side of a sheet with respect to a black image. The reason why attention is given to the color deviation amount between yellow and black is because, in the present embodiment, yellow is the first station performing primary transfer at first, and black is the fourth station performing primary transfer at last. In other words, this is because, in this case, the difference in the torque on the driving roller during the primary transfer is the largest, namely, the load variation is the largest, which significantly causes misregistration.

As illustrated in FIG. 7A, misregistration occurs at the leading edge of the first sheet. As illustrated in FIG. 7C, misregistration in the direction opposite to the first sheet occurs at the rear edge of the third sheet. The misregistration at the leading edge of the first sheet occurs because the developing roller 54 comes into contact to reduce the load torque on the drive roller shaft, and the peripheral velocity of the intermediate transfer belt 30 is faster in the primary transfer of black than in the primary transfer of yellow. On the other hand, the misregistration at the rear edge of the third sheet occurs because the developing roller 54 is separated to increase the load torque on the drive roller shaft, and the peripheral velocity of the intermediate transfer belt 30 is slower in the primary transfer of black than in the primary transfer of yellow.

As illustrated in FIG. 7B, the primary transfer to the second sheet is performed without any change in the load torque. Accordingly, misregistration hardly occurs in the second sheet. It should be noted that, at the leading edge of the first sheet and the rear edge of the third sheet, there is misregistration of magenta and cyan with respect to black, which is not described here. However, the color deviation amount of magenta and cyan with respect to black is not as significant as the color deviation amount of yellow with respect to black.

Since the above-described misregistration does not occur when there is no difference between the peripheral velocity of the photosensitive drum 26 and the peripheral velocity of the intermediate transfer belt 30. Therefore, in the present embodiment, the velocity of the photosensitive drum 26 is adjusted in order to alleviate the color deviation amount.

With regard to the variation of the color deviation amount between colors illustrated in FIGS. 7A to 7C described above, the applicant has studied how much the misregistration is affected by whether a photosensitive drum is new one or has endured for a long time. As a result, the applicant has found that the misregistration is not affected to a significant degree by whether a photosensitive drum is new one or has endured for a long time.

As described above, even though the difference between the peripheral velocity of the photosensitive drum 26 and the peripheral velocity of the intermediate transfer belt 30 is the same, the magnitude of the color deviation amount is different according to the use degree of the intermediate transfer belt 30 (see FIG. 6). Accordingly, in order to correct the velocity of the photosensitive drum 26, it is necessary to correct the velocity according to the use degree of the intermediate transfer belt 30 stored in the nonvolatile memory 171. The correction velocity of the photosensitive drum is determined by executing a below-described photosensitive drum velocity correction sequence, and is stored in the nonvolatile memory 172. This is as described in the above FIG. 8B. After the execution of the photosensitive drum velocity correction sequence, the photosensitive drum is driven and rotated at a rotation velocity based on the velocity stored in the nonvolatile memory 172.

<Photosensitive Drum Velocity Correction Sequence Execution Determining Method>

Even though the peripheral velocity difference between the photosensitive drum 26 and the intermediate transfer belt 30 is the same, the magnitude of the color deviation amount caused by velocity variation of the intermediate transfer belt 30 is different according to the state of use of the intermediate transfer belt 30. Accordingly, when the apparatus main body 2 detects replacement of the intermediate transfer belt unit 31, it is necessary to execute the below-described photosensitive drum velocity correction sequence. The replacement of the intermediate transfer belt unit 31 can be detected by causing the image forming control part 12 to compare the serial number stored in the nonvolatile memory 171 with the serial number of the intermediate transfer belt unit 31 stored in the nonvolatile memory 172 when a door is closed. More specifically, when the serial number stored in the nonvolatile memory 171 is determined to be different from the serial number stored in the nonvolatile memory 172, the image forming control part 12 determines that the intermediate transfer belt unit 31 has been replaced, and performs detection. When a new serial number is detected, the image forming control part 12 updates the serial number of the intermediate transfer belt unit 31 stored in the nonvolatile memory 172 after executing the drum velocity correction sequence.

<Photosensitive Drum Velocity Correction Sequence>

Figure 3B:
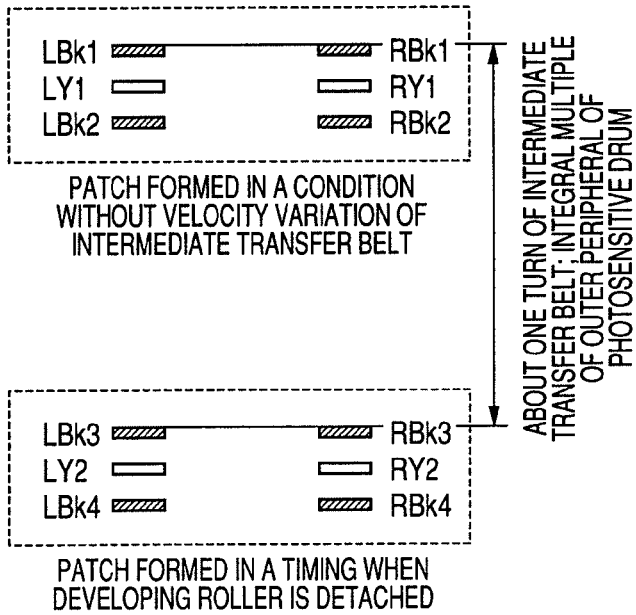
Figure 9:
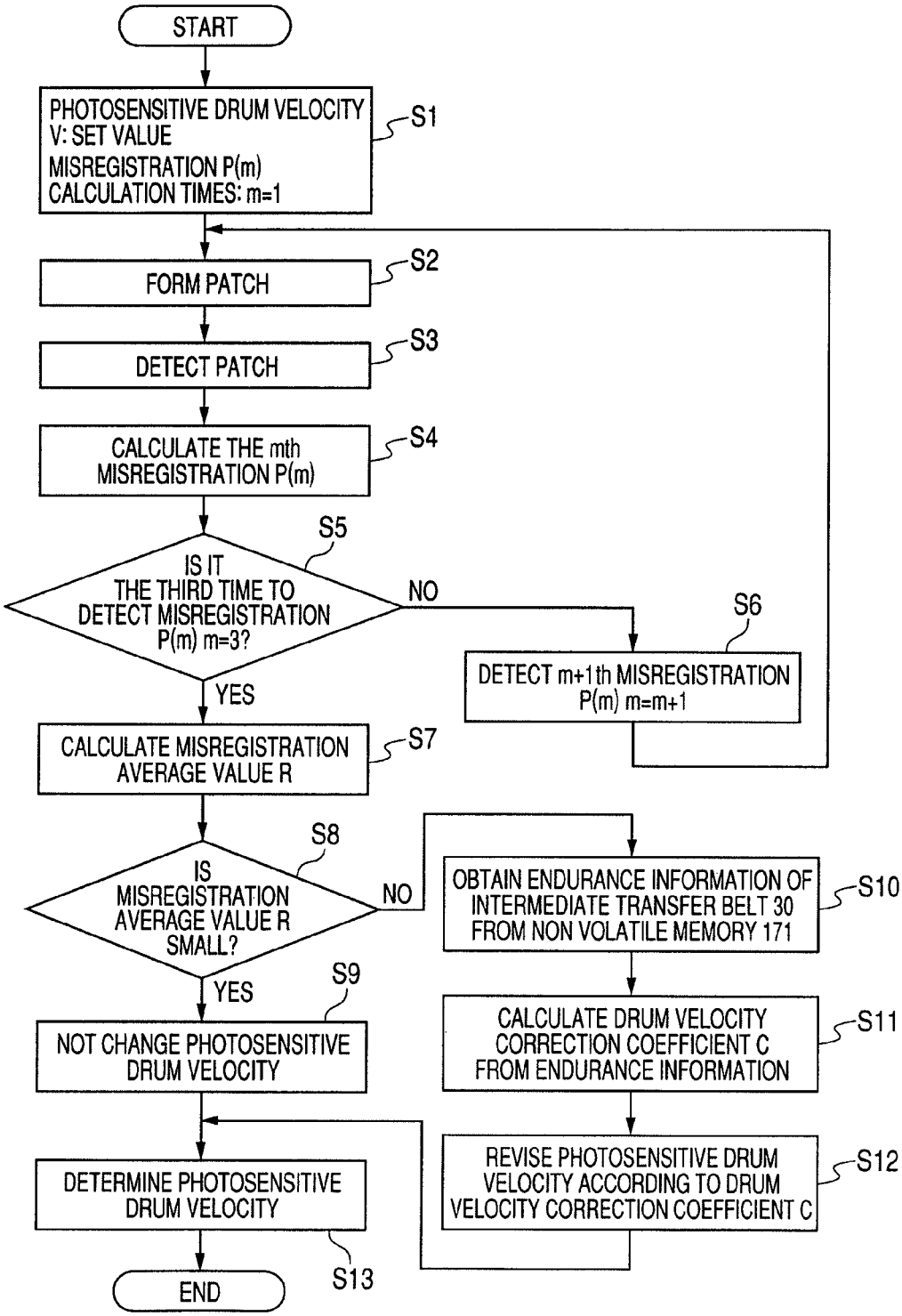
FIG. 9 is a figure illustrating a flowchart of a photosensitive drum velocity correction sequence.
Figure 10:
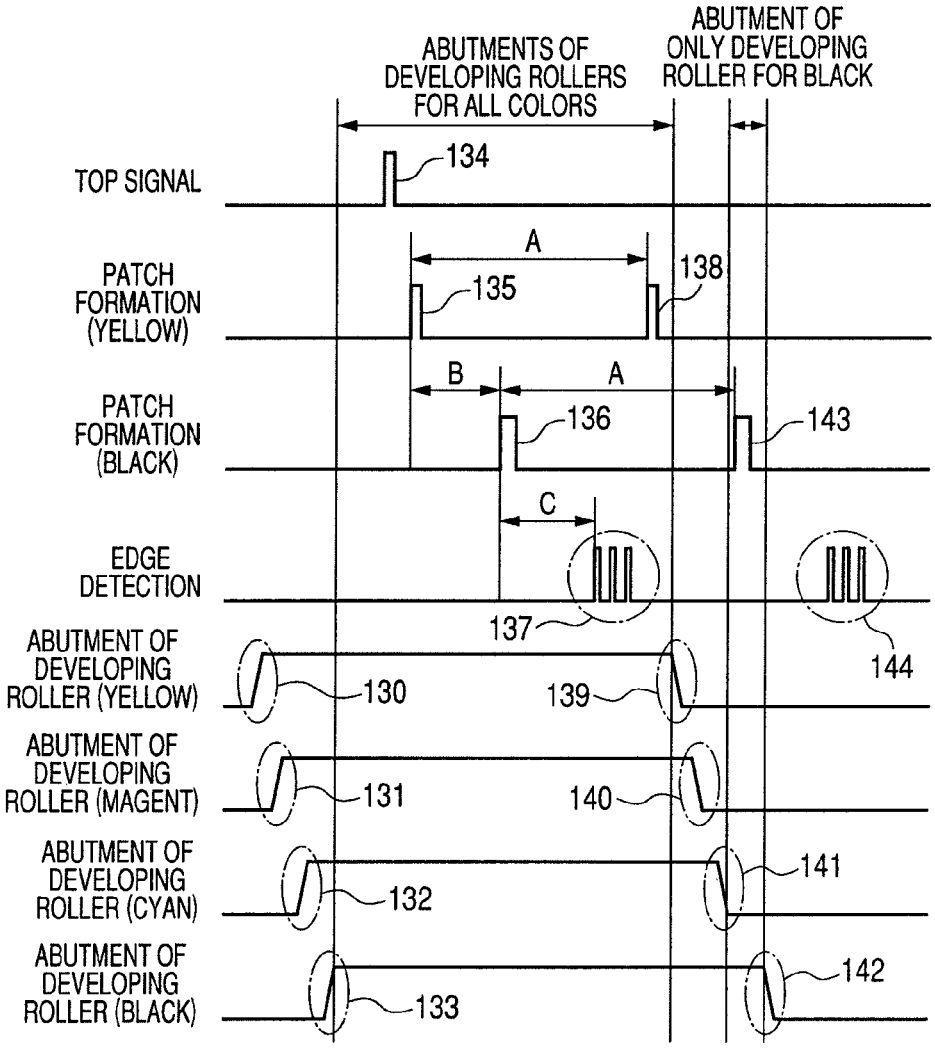
FIG. 10 is a figure illustrating a timing chart of a photosensitive drum velocity correction sequence.

The velocity correction method of the photosensitive drum 26 will be hereinafter described. FIG. 3B illustrates a color deviation amount detection pattern. FIG. 9 illustrates a flowchart of the photosensitive drum velocity correction sequence. FIG. 10 illustrates the timing chart of the color deviation amount detection.

First, as illustrated in FIG. 9, the image forming control part 12 drives the photosensitive drum 26 at a set value V (S1).

Subsequently, the image forming part 13 forms a patch (S2) in order to detect the color deviation amount caused by velocity variation of the intermediate transfer belt 30. It should be noted that the patch mean the color deviation amount pattern illustrated in FIGS. 3A to 3C. Subsequently, the registration detection sensor part 15 detects the patch (S3). In the step of forming the patch in S2, the image forming part 13 forms the color deviation amount pattern illustrated in FIG. 3B according to an instruction given by the image forming control part 12.

Herein, FIG. 10 illustrates a timing chart of the path formation (S2) and the patch detection (S3). In FIG. 10, the vertical axis represents each operation of the image forming apparatus, and the horizontal axis represents time. The timing chart of FIG. 10 will be hereinafter described in detail.

First, the image forming control part 12 brings the yellow developing roller 54 located at the upstream side into contact with the photosensitive drum 26 (130), and then successively brings the other developing rollers of respective colors into contact with the photosensitive drums 26 (130, 131, 132, and 133) in order, so as to start the image forming operation. After the black developing roller 54Bk comes into contact with the photosensitive drum 26Bk (133), a certain period of time passes. Then, after the velocity variation of the intermediate transfer belt 30 converges, the image forming control part 12 outputs a Top signal for patch formation (134).

Then, the image forming part 13 forms the yellow toner patch as illustrated in. FIG. 3B on the intermediate transfer belt. More specifically, the image forming part 13 forms LY1 on the left side and RY1 on the right side on the intermediate transfer belt (135). Thereafter, the image forming part 13 forms black (second color) toner patches LBk1, LBk2, RBk1, and RBk2 (136), which are arranged to keep the same interval in the front and back of LY1 and RY1. At this occasion, in the patches formed for detecting misregistration, toner has entered into the primary transfer nips of all the colors, and the patches are formed in a stable state without any velocity variation of the intermediate transfer belt 30. Since the primary transfer position of yellow is different from the primary transfer position of black, the black color patch is formed later than the yellow color patch. B in FIG. 10 indicates how much time the formation of the black color patch is delayed in time.

In the present embodiment, the toner color whose primary transfer position is located at the uppermost stream and the toner color whose primary transfer position is located at the lowermost stream may be denoted as the first color and the second color, respectively, in order to distinguish them. In the present embodiment, the first color is yellow, and the second color is black. However, it is not limited thereto, depending on the arrangement of the photosensitive drums.

As illustrated in FIG. 3B, one pattern is formed with three patches (marks) such as LBk1, LY1, and LBk2. In fact, several patterns are formed, and each of the patterns include three patches as one set. When it is necessary to distinguish them, the patterns are referred to as the first pattern, the second pattern, the third pattern and so on.

Then, when the formed black color patches LBk1, RBk1 arrive at the detection position of the registration detection sensor 90 (C in FIG. 10), the registration detection sensor 90 detects the rising edges and falling edges of the generated patches, i.e., totally six edges (137). At this occasion, the registration detection sensor detects, as the position of a patch, the midpoint between the detected rising edge and the detected falling edge corresponding to each of the patches. This will be described below in detail with reference to FIG. 3C.

Subsequently, the intermediate transfer belt 30 is rotated, and the intermediate transfer belt cleaning device 32 cleans the previously generated yellow and black color patches LY1, RY1, LBk1, LBk2, RBk1, and RBk2. Thereafter, the image forming part 13 generates yellow color patches LY2 and RY2 (marks in the first color) at positions away from the positions of the yellow color patches LY1 and RY1 by an integral multiple of the external periphery of the photosensitive drum 26, wherein these positions are in substantially the same areas (positions) on the intermediate transfer belt 30 upon about one turn of the intermediate transfer belt 30 (138). A in FIG. 10 indicates the length equivalent to about one turn of the intermediate transfer belt 30. At the time of this 138, toner enters into the primary transfer nips of all the colors, and the intermediate transfer belt 30 is in a stable condition without any velocity variation.

After the primary transfer of the yellow color patches LY2, RY2 is finished, the image forming control part 12 successively separates the developing roller 54 of yellow, magenta, and cyan from the photosensitive drums 26 (139, 140, 141), and finishes the image forming operation of yellow, magenta, and cyan.

Then, after the developing rollers 54 of Y, M, C separate from the photosensitive drums 26, the image forming part 13 forms black color toner patches LBk3, LBk4, RBk3, and RBk4 (marks in the second color) on the intermediate transfer belt 30, which are arranged in the front and back of LY2 and RY2 with the same interval (143). As a result of the toner patch formation at this 143 as well as the toner patches previously formed at the 143, a positional deviation detection pattern (or color deviation amount detection pattern) is formed.

It should be noted that, at the time of this 143, toner transitionally enters into some of the primary transfer nips, but toner does not enter into some of the primary transfer nips. Accordingly, the velocity varies in the intermediate transfer belt 30. Further, the time of this 143 also corresponds to a state where some of the developing devices (developing rollers) are separated or in contact. The image forming part 13 also forms the black color toner patches LBk3, LBk4, RBk3, RBk4 in the same manner as the yellow color toner patches. More specifically, the image forming part 13 forms toner patches LBk3, LBk4, RBk3, RBk4 at positions away from the positions of LBk1, LBk2, RBk1, RBk2 by an integral multiple of the external periphery of the photosensitive drum 26, wherein these positions are in substantially the same areas (positions) on the intermediate transfer belt 30 upon about one turn of the intermediate transfer belt 30.

When the formed patches arrive at the detection positions of the registration detection sensors 90, the registration detection sensors 90 detect the positions of the patches (144).

Herein, in the present embodiment, the patch LY 1 and the like formed in a stable state and the patch LY2 and the like formed in a varying state with the developing rollers 54 being separated are at positions away from each other by an integral multiple of the external periphery of the photosensitive drum 26, wherein these positions are in substantially the same areas (positions) on the intermediate transfer belt 30 upon about one turn of the intermediate transfer belt 30. This is to reduce the affect caused by variation of the external diameter of the photosensitive drum 26 and variation of the film thickness of the intermediate transfer belt 30. It is difficult to manufacture the photosensitive drum 26 having a uniform external diameter, and the external diameter is likely to vary. As a result, depending on the position of the photosensitive drum 26, the peripheral velocity of the photosensitive drum 26 is different. In addition, it is difficult to manufacture the intermediate transfer belt 30 with a uniform film thickness. Since the thickness differs depending on the position, the conveying velocity of the intermediate transfer belt 30 varies. In order to reduce the affect caused by the variation of the external diameter of the photosensitive drum 26 and the variation of the film thickness of the intermediate transfer belt 30 on the difference between the peripheral velocity of the photosensitive drum and the peripheral velocity of the intermediate transfer belt, the patches are formed at positions away by an integral multiple of the external periphery of the photosensitive drum, wherein these positions are in substantially the same areas (positions) on the intermediate transfer belt. It should be noted that the cycle of the variation of the film thickness is equivalent to one turn of the belt, and it is not necessary to arrange the patches at positions on the intermediate transfer belt 30 upon strictly one turn of the intermediate transfer belt 30.

On the other hand, in the above description, the patches are formed at positions away by an integral multiple of the external periphery of the photosensitive drum 26 in order to reduce the affect caused by the variation of the external diameter of the photosensitive drum 26. Alternatively, the patches may be formed at positions away by an integral multiple of the external diameter of the driving roller 100 in order to reduce the affect caused by the variation of the external diameter of the driving roller 100 that drives the intermediate transfer belt 30. More preferably, the patches may be formed at positions away by a common multiple of the external diameter of the photosensitive drum 26 and the external diameter of the driving roller 100.

The flowchart of FIG. 9 will be described again. The image forming control part 12 calculates the color deviation amount from the difference of patch detection timing (S4). The color deviation amount without any velocity variation of the intermediate transfer belt 30 is denoted as S, and the color deviation amount in a timing when the developing roller 54 separates from the photosensitive drum 26 is denoted as U. The color deviation amount S without any velocity variation of the intermediate transfer belt 30 is obtained as follows. First, the color deviation amount L1 and the color deviation amount R1 are calculated according to formula (6) and formula (7). The color deviation amount L1 is defined as the color deviation amount between yellow and black on the left side of the intermediate transfer belt 30. The color deviation amount R1 is the color deviation amount between yellow and black on the right side of the intermediate transfer belt 30.

$$L1=LY1-(LBk1+LBk2)/2 \quad \text{formula (7)}$$

$$R1=RY1-(RBk1+RBk2)/2 \quad \text{formula (8)}$$

Then, as shown in formula (9), the color deviation amount L1 on the left side and the color deviation amount R1 on the right side are averaged, and the color deviation amount S without any velocity variation of the intermediate transfer belt 30 is calculated. It should be noted that this color deviation amount S corresponds to the color deviation amount in the case of static or direct current, i.e., the color deviation amount caused by reasons other than the variation of the force occurring at the primary transfer nips in the tangent direction.

Figure 3C:
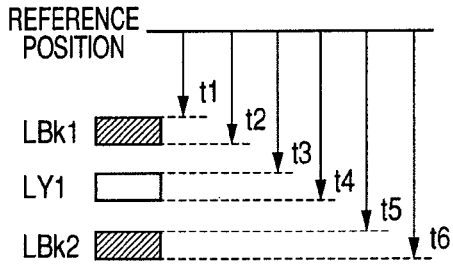

The positions of the toner patches, e.g., the positions LY1, LBk1, and LBk2 are in the relationship as illustrated in FIG. 3C. In FIG. 3C, t1 to t6 denote times it takes for the registration detection sensor 90 to detect the edges of the patches from the reference position (reference timing). The times indicate the positions of the patches. Where LBk1=(t1+t2)/2, LY1=(t3+t4)/2, LBk2=(t5+t6)/2 are satisfied, LY1−(LBk1+LBk2)/2 is zero or substantially zero when there is no misregistration. On the other hand, when there is misregistration, LY1−(LBk1+LBk2)/2 is not zero or substantially zero. The above is also applicable to other patches such as RBk1, RBk2, and the detailed description thereabout is omitted.

$$S=(L1+R1)/2 \quad \text{formula (9)}$$

Subsequently, the color deviation amount U in a timing when the developing roller 54 separates from the photosensitive drum 26 is obtained as follows. First, color deviation amount L2 and the color deviation amount R2 are calculated according to formula (10) and formula (11). The color deviation amount L2 is defined as the color deviation amount on the left side of the intermediate transfer belt 30. The color deviation amount R2 is defined as the color deviation amount on the right side of the intermediate transfer belt 30.

$$L2=LY2-(LBk3+LBk4)/2 \quad \text{formula (10)}$$

$$R2=RY2-(RBk3+RBk4)/2 \quad \text{formula (11)}$$

Then, as shown in formula (12), the color deviation amount L1 on the left side and the color deviation amount R1 on the right side are averaged to calculate the color deviation amount U in a timing when the developing roller is separated.

$$U=(L2+R2)/2 \quad \text{formula (12)}$$

Subsequently, as shown in formula (13), difference P between the color deviation amount S during a stable running condition of the intermediate transfer belt 30 and the color deviation amount U in a timing when the developing roller 54 is separated is calculated to use it for correcting the velocity of the photosensitive drum 26.

$$p=(S-U) \quad \text{formula (13)}$$

In the present embodiment, in order to improve the accuracy of color deviation amount detection, the color deviation amount P caused by the velocity variation of the intermediate transfer belt 30 is detected three times (S5), and the average value thereof is adopted as color deviation amount R used for correcting the velocity of the photosensitive drum (S7).

$$R=(P(1)+P(2)+P(3))/3 \quad \text{Formula (14)}$$

Subsequently, a method for correcting the velocity of the photosensitive drum from the detected color deviation amount average value R (detection result) will be described. The processings of the following steps S8 to S13 are performed by the image forming control part 12.

When the absolute value of the detected color deviation amount average value R is determined to be less than a certain value (S8), the image forming control part 12 determines that the difference between the peripheral velocity of the photosensitive drum 26 and the peripheral velocity of the intermediate transfer belt 30 is small, and employs the current velocity of the photosensitive drum 26 without correcting the velocity of the photosensitive drum (S9). However, even when the absolute value of the color deviation amount average value R is determined to be small, the image forming control part 12 may correct the velocity of the photosensitive drum 26 in order to further reduce the difference in the peripheral velocity.

Figures 11A, 11B:
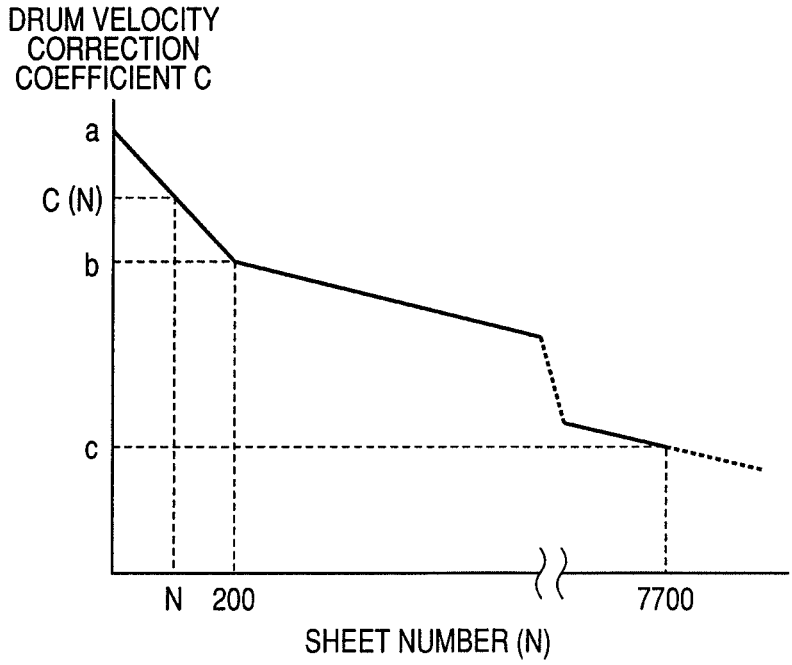
FIGS. 11A and 11B are a figure illustrating an example of a table for associating information about the use degree of the intermediate transfer belt and a drum velocity correction coefficient C.

When the absolute value of the detected color deviation amount average value R is determined to be larger than a certain value (S8), the image forming control part 12 reads the number of sheets on which images are formed stored in the nonvolatile memory 171 (S10). Subsequently, the image forming control part 12 uses the association table including the number of sheets on which images are formed and the drum velocity correction coefficients, C as illustrated in FIGS. 11A and 11B, stored in the ROM 122 of the image forming control part 12 to calculate a drum velocity correction coefficient C according to the number of sheets on which images are formed (S11). The drum velocity correction coefficient C is an example of parameter representing the amount of velocity correction per a unit color deviation amount. It should be noted that the parameter may be in forms other than the drum velocity correction coefficient C, as long as it is a parameter for calculating the amount of velocity correction for correcting a relative velocity between the photosensitive drum and the intermediate transfer member according to the color deviation amount obtained in step S4 of FIG. 9. At this occasion, the ROM 122 of the image forming control part 12 has a limited capacity. Accordingly, the association table illustrated in FIGS. 11A and 11B stores representing values. When the number of sheets on which images are formed which is read from the nonvolatile memory 171 does not agree with any of the representing values, the image forming control part 12 linearly interpolates between a representing value and a representing value, thereby obtaining a drum velocity correction coefficient C with high accuracy.

For example, the number of sheets on which images are formed is denotes as N, and the drum velocity correction coefficient corresponding to the number of sheets N is denoted as C(N).

Where $0 \le N < 200$, $$C(N)=a+(C(200)-a)/(200-0)\times N \quad \text{formula (15)}$$

Where $200 \le N < 7700$, $$C(N)=b+(C(7700)-C(200))/(7700-200)\times(N-200) \quad \text{formula (16)}$$

For the sheet after the 7700th sheet and subsequent sheets, the linear interpolation formula is similarly satisfied according to the relationship between the number of sheets on which images are formed and the drum velocity correction coefficient C illustrated in FIG. 11A. These linear interpolation formulas are stored in the ROM 122 of the apparatus main body 2, and the image forming control part 12 executes calculation. In FIGS. 11A and 11B, the table is illustrated as parameter an output unit for outputting parameters for correcting the velocity of the photosensitive drum according to the number of sheets on which images are formed, i.e., information about use degree. However, the parameter output unit is not limited thereto. The parameter output unit may be the table, and may be realized in various forms, as long as it is a parameter output part for outputting a parameter for correcting the velocity of the photosensitive drum according to information about use degree such as the number of sheets on which images are formed when the information about the use degree is input.

Subsequently, the obtained drum velocity correction coefficient C is used to calculate the velocity Vd of the photosensitive drum when the color deviation amount is zero, i.e., the difference between the peripheral velocity of the photosensitive drum 26 and the peripheral velocity of the intermediate transfer belt 30 is zero or substantially zero (S12). Formula (17) shows a method for calculating the velocity Vd of the photosensitive drum. According to the velocity calculated with formula (17), the velocities of one or more motors driving the photosensitive drum 26 are corrected at a time. The image formation is thereafter performed at the corrected velocity Vd of the photosensitive drum. This corrected velocity of the photosensitive drum Vd corresponds to the rotation velocity of the photosensitive drum illustrated in FIG. 8A.

$$Vd=Vd'-C\times R \quad \text{formula (17)}$$

In the above description, the velocity Vd' of the photosensitive drum 26 is corrected, but the present invention is not limited thereto. The correction may be made in any way as long as the relative velocity between the image bearing member (photosensitive drum) and the intermediate transfer member (intermediate transfer belt) is corrected to zero or substantially zero. For example, the difference between the velocity Vd obtained from formula (17) and the non-corrected velocity Vd' that has not yet corrected may be reflected on the velocity of the intermediate transfer belt, and the moving velocity of the intermediate transfer belt may be corrected.

In the above description, the drum velocity correction coefficient C is calculated from the number of sheets on which images are formed, i.e., the information about the use degree of intermediate transfer belt unit 31. In the photosensitive drum velocity correction sequence, the drum velocity correction coefficient C is used to determine the amount of correction. Therefore, as the accuracy of the drum velocity correction coefficient C improves, the accuracy of the velocity correction of the photosensitive drum 26 can be improved, and the color deviation amount can be alleviated.

Figure 12A:
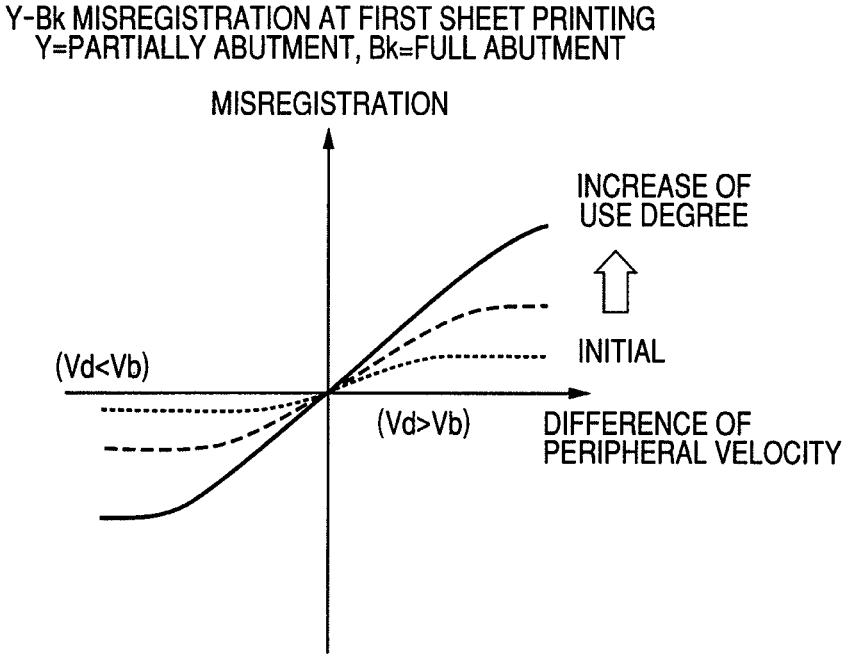
FIGS. 12A and 12B are a figure illustrating an example of a relationship between the color deviation amount caused by the velocity variation of the intermediate transfer belt and the peripheral velocity difference between the photosensitive drum and the intermediate transfer belt.
Figure 12B:
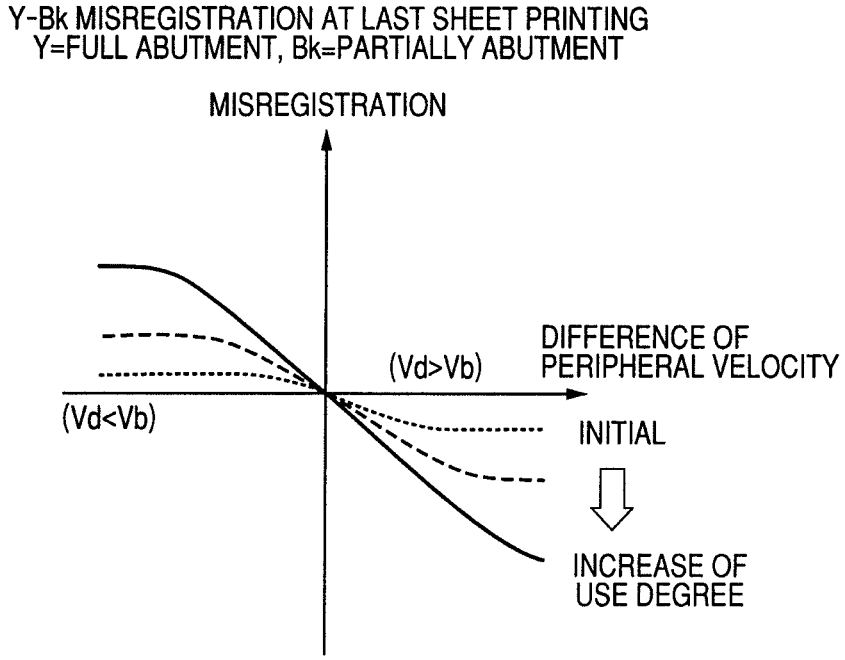

As illustrated in FIG. 12A or FIG. 12B, the drum velocity correction coefficient C is represented by an inclination of a line when the vertical axis denotes the color deviation amount and the horizontal axis denotes the velocity (the difference in the peripheral velocity) of the photosensitive drum 26. As described above, even though the difference in the peripheral velocity is the same, the force exerted at the primary transfer nips in the tangent direction changes according to the use degree of the intermediate transfer belt 30. Accordingly, as the use degree of the intermediate transfer belt 30 increases, the color deviation amount becomes larger. As a result, as illustrated in FIGS. 12A and 12B, the drum velocity correction coefficient C changes according to use degree. In the initial state, the inclination is small, but as the use degree increases, the inclination becomes larger. In the present embodiment, the drum velocity correction coefficient is calculated when the velocity of the photosensitive drum 26 is corrected. Therefore, regardless of the state of use of the intermediate transfer belt 30, the velocity of the photosensitive drum 26 can be corrected in order to alleviate the color deviation amount.

FIG. 12A illustrates misregistration between yellow (Y) and black (Bk) when the first sheet is printed (during primary transfer). More specifically, FIG. 12A illustrates a relationship between the color deviation amount and the velocity of the photosensitive drum 26 with respect to the intermediate transfer belt 30 while a part of the yellow (Y) developing roller is in contact with the photosensitive drum 26 and all of the black (Bk) developing roller is in contact with the photosensitive drum 26. FIG. 12B illustrates misregistration between yellow and black when the last sheet is printed (during primary transfer). More specifically, FIG. 12B illustrates a relationship between the color deviation amount and the velocity of the photosensitive drum 26 with respect to the intermediate transfer belt 30 while all of the black (Bk) developing roller is in contact with the photosensitive drum 26.

According to the above embodiments, the difference of the peripheral velocity of the image bearing member and the peripheral velocity of the intermediate transfer member can be flexibly reduced, and the color deviation amount can be alleviated. Further, during the image forming operation, the velocity variation of the intermediate transfer member can be flexibly suppressed without excessively reducing the lifespan of the image forming unit, and the color deviation amount can be alleviated. In other words, a mechanism can be provided in view of the causes affecting the degree of variation of the force, in the tangent direction, that is exerted between the image bearing member (photosensitive drum) and the intermediate transfer member (intermediate transfer belt). As described above, in the present embodiment, regardless of the state of use of the intermediate transfer belt unit 31, the velocity of the photosensitive drum 26 and the velocity of the intermediate transfer belt 30 can be made the same. As a result, the misregistration can be suppressed.

In the first embodiment, the method for calculating the drum velocity correction coefficient C, read from the table in the ROM 122 associating the number of sheets on which images are formed and the drum velocity correction coefficient C, based on the number of sheets on which images are formed with the intermediate transfer belt unit that is stored in the nonvolatile memory 171. In the present embodiment, more flexible calculation of the drum velocity correction coefficient in view of the affect of the tolerance of the intermediate transfer belt unit will be described. In the below description, the difference from the first embodiment will be mainly described.

<Nonvolatile Memory Arranged on Intermediate Transfer Belt Unit>

Figure 13:
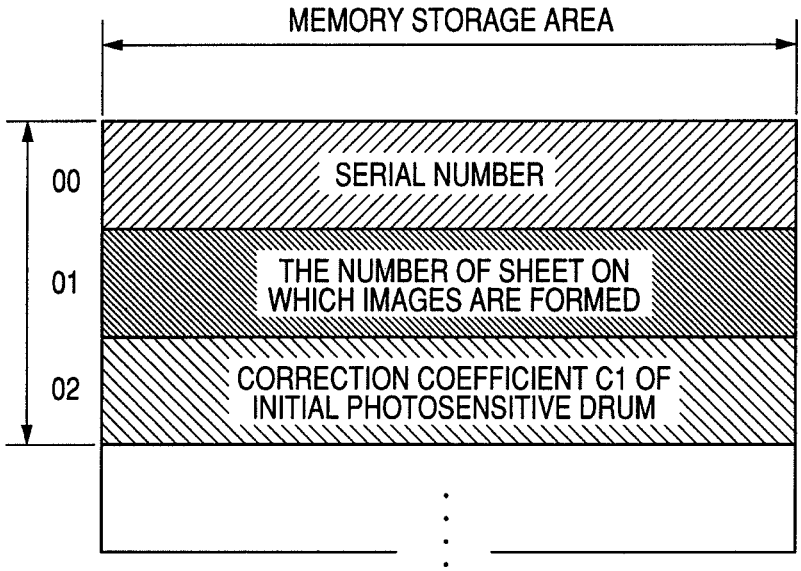
FIG. 13 is a figure illustrating a data map of an intermediate transfer belt unit nonvolatile memory.

The CPU 121 reads data from and writes data into the nonvolatile memory 171 arranged on the intermediate transfer belt unit. The nonvolatile memory 171 according to the present embodiment stores the serial number of the intermediate transfer belt unit, the number of sheets on which images are formed, and the initial photosensitive drum velocity correction coefficient C1. FIG. 13 illustrates a data map recorded in the nonvolatile memory 171 according to the present embodiment.

<Initial Photosensitive Drum Velocity Correction Coefficient C1 Obtaining Sequence>

Figure 14:
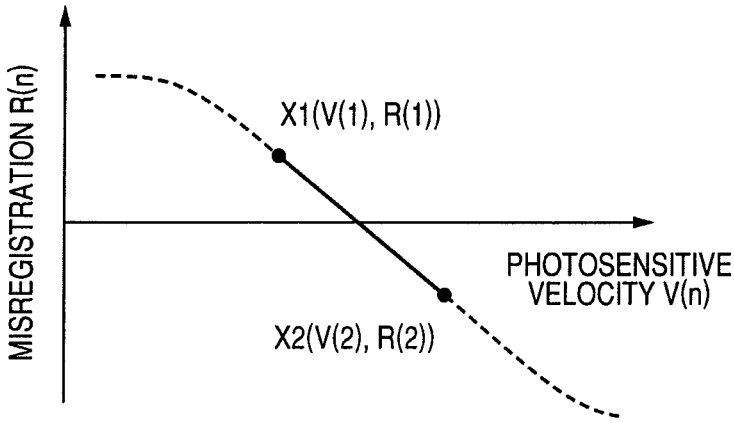
FIG. 14 is a figure illustrating an example of a relationship between the amount of misregistration and the velocity of the photosensitive drum.

For example, the initial photosensitive drum velocity correction coefficient C1 is obtained by performing the initial photosensitive drum velocity correction coefficient C1 obtaining sequence right after the intermediate transfer belt has been assembled at a factory. The initial photosensitive drum velocity correction coefficient C1 is a parameter representing the amount of velocity correction per a unit color deviation amount when the intermediate transfer belt unit 31 is new. In other words, in FIG. 14, it is variation in the X axis direction when variation of unit amount occurs in the Y axis direction. Therefore, as illustrated in FIG. 14, the initial photosensitive drum velocity correction coefficient C1 can be calculated as follows: X1(Vd(1), R(1)) and X2(Vd(2), R(2)) are obtained; and the initial photosensitive drum velocity correction coefficient C1 is calculated from the two points, i.e., X1 and X2.

Figure 15:
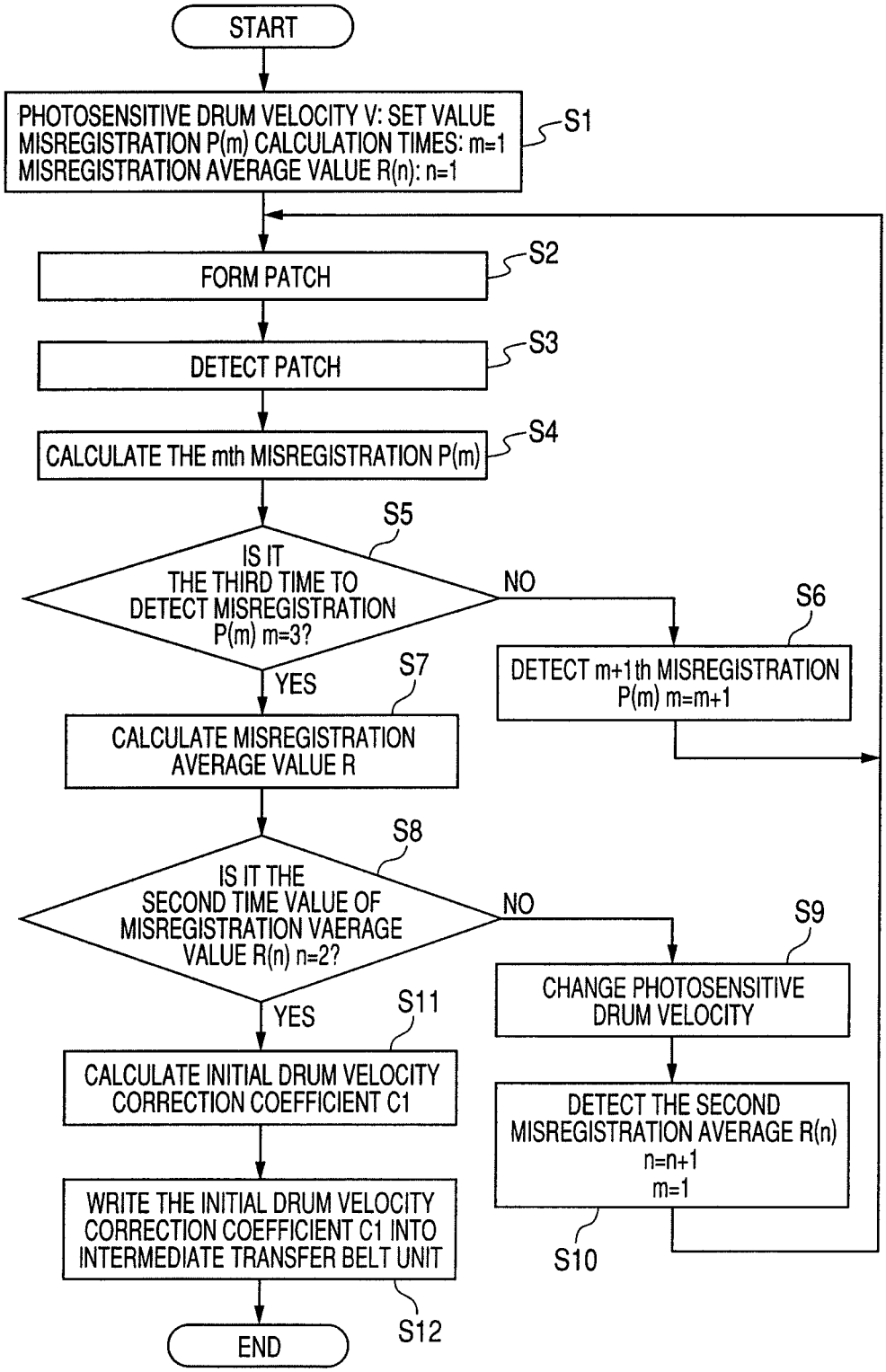
FIG. 15 is a figure illustrating a flowchart of an initial photosensitive drum velocity correction coefficient C1 obtaining sequence.

The initial photosensitive drum velocity correction coefficient C1 obtaining sequence will be hereinafter described with reference to FIG. 15.

The initial photosensitive drum velocity correction coefficient C1 obtaining sequence is executed when a new intermediate transfer belt unit 31 is attached. Steps S1 to S7 in FIG. 15 illustrating the pattern formation, the pattern detection, and the calculation method for the color deviation amount are the same as those of the first embodiment, and the description thereabout is omitted.

When the detected color deviation amount average value R (2) has not yet been obtained (S8), the image forming control part 12 changes the velocity of the velocity of the photosensitive drum (S9), and the image forming control part 12 makes preparation for detecting the color deviation amount average value R (2) at a velocity Vd (2) of the photosensitive drum that is different from the velocity Vd (1) of the photosensitive drum (S10). When the color deviation amount average value R (1) is determined to be plus, the image forming control part 12 increases the peripheral velocity of the photosensitive drum 26 by 0.1%, for example. On the other hand, when the color deviation amount average value R (1) is determined to be minus, the image forming control part 12 decreases the velocity of the peripheral velocity of the photosensitive drum 26 by 0.1%, for example. In the present embodiment, the velocity Vd(2) of the photosensitive drum 26 is a value 0.1% less than Vd(1). However, Vd(2) is preferably set within a range in which the velocity of the photosensitive drum 26 and the color deviation amount are in a linear relationship.

Then, the image forming control part 12 performs step S10, and then, performs the processings in steps S1 to S7 of the first embodiment again, thus calculating the color deviation amount average value R (2) at the peripheral velocity Vd(2) of the photosensitive drum 26. Then, when the image forming control part 12 determines YES in step S8 for the second time, the image forming control part 12 proceeds to step S11.

Subsequently, the image forming control part 12 uses obtained X1(Vd(1), R(1)) and X2(Vd(2),R(2)) to calculate the initial photosensitive drum velocity correction coefficient C1 according to formula (18) (S11).

$$C1=(Vd(1)-Vd(2))/(R(1)-R(2)) \quad \text{formula (18)}$$

At the last, the CPU 121 of the image forming control part 12 writes the photosensitive drum velocity correction coefficient C1, obtained from formula (18), into the nonvolatile memory 171 of the intermediate transfer belt unit. FIG. 13 illustrates the data stored in the nonvolatile memory 171 at this occasion.

<Photosensitive Drum Velocity Correction Sequence>

The photosensitive drum velocity correction sequence according the present embodiment is different from the drum velocity correction sequence described in the first embodiment with respect to the process for calculating the drum velocity correction coefficient C. Accordingly, the difference will be hereinafter described.

When the absolute value of the detected color deviation amount average value R is more than a certain value (FIG. 9, S8), the image forming control part 12 reads the initial photosensitive drum velocity correction coefficient C1 and the number of sheets on which images are formed with the intermediate transfer belt unit which are stored in the nonvolatile memory 171 (FIG. 9, S10). Subsequently, the image forming control part 12 uses the association table including the number of sheets on which images are formed and the calculation coefficient Q as illustrated in FIG. 16 stored in the ROM 122 to calculate the calculation coefficient Q according to the number of sheets on which images are formed which is read from the ROM 122. Since the ROM 122 has a limited capacity, the association table illustrated in FIG. 16 stores information about representing values. When the number of sheets on which images are formed which is read from the nonvolatile memory 171 does not agree with any of the representing values, the image forming control part 12 linearly interpolates between representing values, thereby calculating the drum velocity correction coefficient C and the calculation coefficient Q with high accuracy.

For example, the number of sheets on which images are formed is denoted as N, and the calculation coefficient of the drum velocity correction coefficient C corresponding to the number of sheets N is denoted as Q(N).

Where $0 \leq N < 200$, $$Q(N)=1+(Q(200)-1)/(200-0)\times N \quad \text{formula (19)}$$

Where $200N<7700$, $$Q(N)=a+(Q(7700)-Q(200))/(7700-200)\times(N-200) \quad \text{formula (20)}$$

For the 7700th and subsequent sheets, the linear interpolation formula is similarly satisfied according to the relationship between the number of sheets on which images are formed and the calculation coefficient Q illustrated in FIG. 16. These linear interpolation formula are stored in the ROM 122 of the apparatus main body 2, and the image forming control part 12 executes calculation.

Subsequently, the drum velocity correction coefficient C is obtained according to the formula (21) shown below.

$$C=Q\times C1 \quad \text{formula (21)}$$

The drum velocity correction method using the drum velocity correction coefficient C is the same as that of the first embodiment, and the description thereabout is omitted.

When the external diameter of the driving roller 100, based on which the conveying velocity of the intermediate transfer belt 30 is determined, is a design center value, the difference between the peripheral velocity of the photosensitive drum 26 and the peripheral velocity of the intermediate transfer belt 30 can be set to zero or substantially zero in advance. However, the external diameter of the driving roller 100 varies within a range of tolerance. Therefore, the velocity of the intermediate transfer belt 30 increases or decreases according to the amount of deviation with respect to the design center value, and there arises the peripheral velocity difference between the photosensitive drum 26 and the intermediate transfer belt 30, which causes misregistration.

In the photosensitive drum velocity correction sequence according to the present embodiment, the drum correction velocity is determined according to the initial photosensitive drum velocity correction coefficient C1 obtained, for example, right after the assembly at a factory, and according to the number of sheets on which images are formed, i.e., information about the use degree of the intermediate transfer belt unit 31. Therefore, even when the external diameter of the photosensitive drum 26 and the external diameter of the driving roller 100 are out of design center values as described above, the velocity of the photosensitive drum 26 and the velocity of the intermediate transfer belt 30 can be made the same. As a result, the misregistration can be suppressed.

In the first embodiment and the second embodiment, the color deviation amount S is calculated, when there is no variation in the force in the tangent direction, namely, when the intermediate transfer belt 30 is running in a stable manner. However, the calculation of the color deviation amount S may be omitted in the following case: before the color deviation amount detection sequence illustrated in FIG. 9, the writing positions of the patterns are corrected such that the color deviation amount S attains zero while the intermediate transfer belt 30 is running in a stable manner.

In this case, the flowchart of FIG. 9 may be executed without performing the calculations of formula (9) and formula (10) and the processings of 135, 136, 137 in FIG. 10. When the misregistration correction is executed in advance, and the flowchart of FIG. 9 is executed, the time taken for forming and detecting the toner patches can be reduced. The previously-executed misregistration correction is a well-known technique for forming misregistration detection toner patches for four colors and correcting the position of an adjusted color (a color other than yellow) with respect to a reference color (for example, yellow). Therefore, the detailed description thereabout is omitted here. On the other hand, when the flowchart of FIG. 9 of the first embodiment is executed while there is no misregistration (S calculated by the above-described formula (9) is zero), the processings of 135, 136, 137 of FIG. 10 may be omitted.

As described above, the embodiments are characterized in that at least both of the yellow color toner patch (138) and the black color toner patch (143) are formed, wherein the yellow color toner patch (138) is formed in a stable state in which toners have entered into all the primary transfer nips and the black color toner patch (143) is formed in a varying state in which toners have entered into some of the primary transfer nips. In the patch formation in 135, 136 of FIG. 10, the misregistration correction is performed in a simple manner to cause the color deviation amount S to be zero in advance, so that the convenience for the user is improved.

In the above-described embodiments, the method for detecting the misregistration at the time of the separation of the developing roller 54 has been described. Alternatively, the color deviation amount P may be calculated by detecting the misregistration when the developing roller 54 comes into contact with the photosensitive drum 26.

More specifically, first, the developing device 51 for only the yellow developing roller is brought into contact at 130 (FIG. 10). The processing of 135 is executed in a varying state in which there is velocity variation in the intermediate transfer belt. The processing of 136 is executed in a stable state in which all the developing devices 51 are in contact. The processing 138 and 143 are performed in a stable state in which all the developing devices 51 are in contact. Then, when the absolute value of the detected color deviation amount average value R (n) is determined to be more than a certain value (FIG. 9, NO in S8), the same processings as those in S10 to S13 described in FIG. 9 are performed. However, since the misregistration occurs in the direction opposite to the first embodiment, the difference is that step S11 of FIG. 9 is executed with the formula (17) being $Vd=Vd'-C\times(-R)$.

As described above, not only when the developing device 51 is separated but also when the developing device 51 begins to come into contact, e.g., when the first page of a print job is primarily transferred, the color deviation amount can be flexibly alleviated without excessively reducing the lifespan of the image forming unit. In other words, an image forming apparatus can be provided in view of the causes affecting the degree of variation of the force, in the tangent direction, that is exerted between the image bearing member (photosensitive drum) and the intermediate transfer member (intermediate transfer belt).

In the above-described embodiments, the nonvolatile memory 171 is arranged on the intermediate transfer belt unit 31. Alternatively, the above-described information about the use degree may be stored in the nonvolatile memory 172 arranged on the apparatus main body 2. In this case, the data illustrated in FIG. 8B may be added to the image forming control part 12 (CPU 121) and stored in the nonvolatile memory 172, and the data may be read and updated as necessary. Then, the above-described first to fourth embodiments may be carried out based on the data of FIGS. 8A and 8B stored in the non-volatile memory 172.

In the description of the above-described embodiments, the detection is executed by comparing the serial number of the intermediate transfer belt unit 31 stored in the nonvolatile memory 171 and the serial number of the intermediate transfer belt unit 31 stored in the nonvolatile memory 172. Alternatively, information about replacement of a new intermediate transfer belt unit 31 may be input according to an instruction given by a user with an operation panel, not illustrated in FIG. 2, and the replacement may be detected based on the input information. In this case, the processing of storing the serial number of the intermediate transfer belt unit 31 in the nonvolatile memories 171, 172 can be omitted. Accordingly, the memory capacity can be saved.

In the above-described photosensitive drum velocity correction sequence, the velocity of the photosensitive drum 26 is corrected so that the color deviation amount attains zero, namely, the difference between the peripheral velocity of the photosensitive drum 26 and the peripheral velocity of the intermediate transfer belt 30 attains zero or substantially zero. However, the peripheral velocity difference between the photosensitive drum 26 and the intermediate transfer belt 30 may affect transfer efficiency. Therefore, in some cases, a certain degree of difference may be necessary between the peripheral velocity of the photosensitive drum 26 and the peripheral velocity of the intermediate transfer belt 30. In other words, when there is a certain degree of difference in the peripheral velocity, the toner on the photosensitive drum 26 is likely to be removed, and the transfer efficiency is improved. When the drum velocity correction coefficient C is calculated according to the method described in the second embodiment, the relationship between the color deviation amount and the difference in the peripheral velocity can be understood. Accordingly, any desired difference in the peripheral velocity can be achieved. Therefore, by performing the photosensitive drum velocity correction sequence, the relationship in terms of velocity between the photosensitive drum 26 and the intermediate transfer belt 30 can be set in view of the color deviation amount and the transfer efficiency. Although the velocity of the photosensitive drum 26 is corrected, the velocity of the intermediate transfer belt 30 may be corrected according to the same method.

Further, the velocity of the photosensitive drum and the velocity of the intermediate transfer belt may be deviated from design center values due to variation of the environment temperature and the temperature in the apparatus during successive sheet feeding operation. In such case, a temperature detection unit may be arranged in the apparatus main body and in proximity to the photosensitive drum and the driving roller, and when a predetermined temperature rise is detected, misregistration can be prevented by executing the photosensitive drum velocity correction sequence. In a case of an image forming apparatus in which a photosensitive belt and an intermediate transfer drum are employed as image bearing members, the velocity of the photosensitive belt and the velocity of the intermediate transfer drum may be corrected by performing similar velocity correction sequence.

In the above-described embodiments, the relationship between the photosensitive drum 26 and the intermediate transfer belt 30 has been described. Alternatively, the patches may be formed on the transfer material conveying belt (on the transfer material bearing member), for example. Further, the embodiments can be applied to an image forming apparatus in which a primary transfer method is employed to directly transfer a toner image developed on the photosensitive drum 26 onto a recording material. In this case, the intermediate transfer belt 30 on which the patches are formed in the above-described embodiments may be replaced with a transfer material conveying belt (transfer material bearing member) which conveys a transfer material (recording material) on which a toner image developed on the photosensitive drum 26 is directly, primarily transferred. In other words, in the relationship between the photosensitive drum 26 and the transfer material conveying belt, the processings including the above-described flowchart of FIG. 9 are executed in a similar manner. In this case, a member equivalent to the nonvolatile memory 171 may be arranged on the transfer material conveying belt unit. As a result, correction can be performed so that the relative difference between the peripheral velocity of the photosensitive drum 26 and the peripheral velocity of the transfer material conveying belt is eliminated (reduced to zero or substantially zero), and the same effects as the above-described embodiments can be obtained.

As described above, the processings of the above-described embodiments can be applied to the relationship between the photosensitive drum 26 and a rotating member such as the intermediate transfer belt and the transfer material conveying belt (transfer material bearing member) arranged to face the photosensitive drum 26 and move for performing image formation.

In the aforementioned explanation, it is described that the color deviation amount between the yellow color patch and the black color patch is detected, wherein the yellow color patch is formed by contacting the developing devices in the case where toner comes into all of the primary transfer nip parts and the black color patch is formed by contacting the developing devices in the case where toner comes into only the primary transfer nip part of black color. Also, it is described that the color deviation amount between the yellow color patch and the black color patch is detected, wherein the yellow color patch is formed by contacting the developing devices in the case where toner comes into only the primary transfer nip part of yellow color and the black color patch is formed by contacting the developing devices in the case where toner comes into all of the primary transfer nip parts. The number of nips into which toner enters, however, is not restricted in the aforementioned embodiments.

For example, the detection can be executed for the color deviation amount between the yellow color patch and the black color patch, wherein the yellow color patch is formed by contacting the developing devices in the case where toner comes into two or more primary transfer nip parts and the black color patch is formed by contacting the developing devices in the case where toner comes into primary transfer nip parts whose numbers are less than the number of the nip parts in the case of forming the yellow color patch. Also, the detection can be executed for the color deviation amount between the black color patch and the yellow color patch, wherein the black color patch is formed by contacting the developing devices in the case where toner comes into two or more primary transfer nip parts and the yellow color patch is formed by contacting the developing devices in the case where toner comes into primary transfer nip parts whose numbers are less than the number of the nip parts in the case of forming the black color patch. By these detections, it can detect the color deviation amount according to the peripheral velocity difference between two rotation members so that the correction coefficient is adjusted according to the color deviation amount and the relative velocity difference between two rotation members can be adequately set. The same effect as the aforementioned embodiments can be obtained by these cases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-198635, filed Aug. 28, 2009 which is hereby incorporated by reference herein in its entirety.

What is claimed is:

1. An image forming apparatus comprising an image forming unit that includes a plurality of image bearing members and a plurality of transfer members, which form nip parts with the plurality of the image bearing members through an intermediate transfer member onto which a toner image developed on each of the plurality of image bearing members is transferred or through a transfer material bearing member bearing a transfer material onto which the toner image developed on each of the plurality of image bearing members is directly transferred, the image forming apparatus comprising:

a pattern forming unit that controls the image forming unit to form a position deviation detection pattern on the intermediate transfer member or the transfer material bearing member, the position deviation detection pattern including a first mark and a second mark, wherein when the first mark is formed, toners have entered into two or more nip parts among the nip parts, and when the second mark is formed, toners have entered into nip parts numbering less than the number of the two or more nip parts into which toners have entered when the first mark is formed;

a detection unit which detects positions of the first mark and the second mark which are included in the position deviation detection pattern;

a memory that stores history data of use of the intermediate transfer member or the transfer material bearing member; and a correction unit which corrects a relative velocity between the image bearing members and the intermediate transfer member or the transfer material bearing member, based on the positions of the first mark and the second mark which are detected by the detection unit and the history of use of the intermediate transfer member or the transfer material bearing member stored in the memory.

2. An image forming apparatus according to claim 1, wherein the detection unit detects an amount of deviation from the positions of the first mark and the second mark, and the correction unit corrects the relative velocity between the image bearing members and the intermediate transfer member or the transfer material bearing member, based on the amount of deviation and the history data of use of the intermediate transfer member or the transfer material bearing member stored in the memory.

3. An image forming apparatus according to claim 1, further comprising a parameter output unit which outputs a parameter, according to the history data of use, for correcting the relative velocity, wherein the correction unit corrects the relative velocity between the image bearing members and the intermediate transfer member or the transfer material bearing member, based on the amount of deviation and the parameter output from the parameter output unit according to the history data of use.

4. An image forming apparatus according to claim 1, further comprising a plurality of developing devices that are capable of contacting with or separating from each of the plurality of the image bearing members, wherein when the first mark is formed, the plurality of the image bearing members is in a condition where two or more developing devices among all of the plurality of the developing devices contact corresponding two or more image bearing members, and wherein when a second mark is formed, developing devices whose numbers are less than the number of the two or more developing devices which contact the corresponding two or more image bearing members in the condition, contact corresponding image bearing members.

5. An image forming apparatus according to claim 1, further comprising:

a calculation unit which calculates a correction coefficient for a relative velocity for correcting the relative velocity between the image bearing members and the intermediate transfer member or the transfer material bearing member;

a storage unit which stores the correction coefficient of the relative velocity calculated by the calculation unit in the memory; and a reading unit which reads the correction coefficient of the relative velocity stored in the memory, wherein the detection unit detects the amount of deviation from the positions of the first mark and the second mark, and wherein the correction unit corrects the relative velocity between the image bearing members and the intermediate transfer member or the transfer material bearing member, based on data regarding both the amount of deviation and the history of use of the intermediate transfer member or the transfer material bearing member stored in the memory.

6. An image forming apparatus according to claim 5, wherein the pattern forming unit controls the image forming unit to form a first pattern and a second pattern at a plurality of the relative velocities as the position deviation detection pattern, wherein the calculation unit calculates the correction coefficient for the relative velocity, based on the positions of the first mark and the second mark detected by the detection unit in the first pattern and the positions of the first mark and the second mark detected by the detection unit in the second pattern.

7. An image forming apparatus according to claim 1, wherein the history data of use of the intermediate transfer member is a number of sheets on which images are formed or a time for which the intermediate transfer member is rotated.

8. An image forming apparatus according to claim 1, wherein the memory is arranged on the intermediate transfer member, the transfer material bearing member or an apparatus main body.

9. An image forming apparatus comprising an image forming unit that includes a plurality of image bearing members, a plurality of developing devices that are capable of contacting with or separating from each of the plurality of the image bearing members and a plurality of transfer members, which form nip parts with the plurality of the image bearing members through an intermediate transfer member onto which a toner image developed on each of the plurality of image bearing members by the plurality of developing devices is transferred or through a transfer material bearing member bearing a transfer material onto which the toner image developed on each of the plurality of image bearing members is directly transferred, the image forming apparatus comprising:

a pattern forming unit that controls the image forming unit to form a position deviation detection pattern on the intermediate transfer member or the transfer material bearing member, the position deviation detection pattern including a first mark and a second mark, wherein when the first mark is formed, the plurality of the image bearing members are in a condition where two or more developing devices among the plurality of the developing devices contact corresponding two or more image bearing members, and when the second mark is formed, developing devices numbering less than the number of the two or more developing devices which contact the corresponding two or more image bearing members in the condition, contact at least one corresponding image bearing member;

a detection unit which detects positions of the first mark and the second mark which are included in the position deviation detection pattern;

a memory that stores history data of use of the intermediate transfer member or the transfer material bearing member; and a correction unit that corrects a relative velocity between the image bearing members and the intermediate transfer member or the transfer material bearing member, based on the positions of the first mark and the second mark which are detected by the detection unit and the history data of use of the intermediate transfer member or the transfer material bearing member stored in the memory.

10. An image forming apparatus according to claim 9, wherein the detection unit detects an amount of deviation from the positions of the first mark and the second mark, and the correction unit corrects the relative velocity between the image bearing members and the intermediate transfer member or the transfer material bearing member, based on the amount of deviation and the history data of use of the intermediate transfer member or the transfer material bearing member stored in the memory.

11. An image forming apparatus according to claim 9, further comprising a parameter output unit which outputs a parameter, according to the history data of use, for correcting the relative velocity, wherein the correction unit corrects the relative velocity between the image bearing member and the intermediate transfer member or the transfer material bearing member, based on the amount of deviation and the parameter output from the parameter output unit according to the history data of use.

12. An image forming apparatus according to claim 9, wherein when the first mark is formed, toners have entered into two or more nip parts among the nip parts by the condition where the two or more developing devices contact the corresponding two or more image bearing members, and wherein when the second mark is formed, toner enters into nip parts numbering less than the number of the two or more nip parts into which toners enter when the first mark is formed, by a condition in which developing devices numbering less than the number of the two or more developing devices which contact the corresponding two or more image bearing members when the first mark is formed, contact corresponding image bearing members.

13. An image forming apparatus according to claim 9, further comprising:

a calculation unit which calculates a correction coefficient for a relative velocity for correcting the relative velocity between the image bearing members and the intermediate transfer member or the transfer material bearing member;

a storage unit which stores the correction coefficient of the relative velocity calculated by the calculation unit in the memory; and a reading unit which reads the correction coefficient of the relative velocity stored in the memory, wherein the detection unit detects the amount of deviation from the positions of the first mark and the second mark, and wherein the correction unit corrects the relative velocity between the image bearing members and the intermediate transfer member or the transfer material bearing member, based on data regarding both the amount of deviation and the history of use of the intermediate transfer member or the transfer material bearing member stored in the memory.

14. An image forming apparatus according to claim 13, wherein the pattern forming unit controls the image forming unit to form a first pattern and a second pattern at a plurality of the relative velocities as the position deviation detection pattern, wherein the calculation unit calculates the correction coefficient for the relative velocity, based on the positions of the first mark and the second mark detected by the detection unit in the first pattern and the positions of the first mark and the second mark detected by the detection unit in the second pattern.

15. An image forming apparatus according to claim 9, wherein the history data of use of the intermediate transfer member is a number of sheets on which images are formed or a time for which the intermediate transfer member is rotated.

16. An image forming apparatus according to claim 9, wherein the memory is arranged on the intermediate transfer member, the transfer material bearing member or an apparatus main body.

17. An image forming apparatus according to claim 1, wherein when the first mark is formed, toners have entered into all of the nip parts.

18. An image forming apparatus according to claim 9, wherein when the first mark is formed, the plurality of developing devices contact all of the plurality of image bearing members.

* * * * *